US006059668A

United States Patent [19]

Marley, Jr.

[11] Patent Number: 6,059,668

[45] Date of Patent: May 9, 2000

[54] GOLF CLUB SWING TRAINING METHOD

[76] Inventor: David E. Marley, Jr., 5607 Marilane Dr., Yakima, Wash. 98902

[21] Appl. No.: 09/225,902

[22] Filed: Jan. 4, 1999

Related U.S. Application Data

[62] Division of application No. 08/920,490, Aug. 29, 1997, Pat. No. 5,860,871.

[51] Int. Cl.[7] ..... A63B 69/36

[52] U.S. Cl. ..... 473/220; 473/218; 473/409

[58] Field of Search ..... 473/218, 220

[56] References Cited

U.S. PATENT DOCUMENTS

| | | | |
|---|---|---|---|
| 5,435,562 | 7/1995 | Stock et al. | 473/220 |
| 5,452,897 | 9/1995 | Mick | 473/218 |
| 5,464,220 | 11/1995 | Hansen et al. | 473/218 |
| 5,467,991 | 11/1995 | White et al. | 473/220 |
| 5,527,041 | 6/1996 | Terry, III et al. | 473/220 |
| 5,788,588 | 8/1998 | Hooker | 473/220 |

*Primary Examiner*—Jeanette Chapman
*Assistant Examiner*—Raeann Gorden
*Attorney, Agent, or Firm*—Stratton Ballew PLLC

[57] ABSTRACT

A golf swing trainer, and more particularly a kinesthetic golf swing plane training device and a method for golfers to train and perfect their swinging of a golf club is provided. The golf swing training device includes a training light adapted to be attachable to a shaft of a golf club. The training light is directed to project a head beam of light and a grip beam of light. The head beam of light projects parallel to the shaft of the golf club, toward the head of the golf club and the grip beam of light projects parallel to the golf club shaft, toward the grip of the golf club. The golf swing training device also includes a swing platform that includes a ground positioned pair of parallel tracks. An optically reflective means for reflecting the head beam of light as projected by the training light, and for reflecting the grip beam of light as projected by the training light is provided on the swing platform. The swing platform is preferably adjustable to suit various club lengths and club types.

5 Claims, 23 Drawing Sheets

90

90

90

61
90
60
92
62

61
90
60
92
62

61
90
90
60
92
92
62

GOLF CLUB SWING TRAINING METHOD

CROSS REFERENCE TO RELATED APPLICATION

This application is a divisional of U.S. patent application Ser. No. 08/920,490, filed Aug. 29, 1997 now U.S. Pat. No. 5,860,871.

TECHNICAL FIELD

The invention relates to a method and apparatus for a golf swing trainer, and more particularly to a kinesthetic golf swing plane training device and a method for golfers to train and perfect their swinging of a golf club.

BACKGROUND OF THE INVENTION

The game of golf is an exact and mentally demanding sport. The physical requirements of the game, though not considered exhaustive, require a high level of precision and expertise, especially if a golfer desires to excel. Golf is also a popular pastime, with a long history of training aids and devices for improving the skills of the golfer, on or away from the golf course. Many of these devices attempt to train the swing of the golfer by helping the golfer to modify and improve their swing.

The U.S. Pat. No. 2,080,608 issued to Hannaford is one such training device. Hannaford '608 discloses a stick that includes an electric lamp to project a beam from one end of the stick. The Hannaford '608 patent also includes a mat with a light reflecting surface. The player uses the stick to swing in his normal manner and observes the trace of the light beam upon the reflective mat to diagnose the accuracy of his swing. Hannaford '608 fails to teach a swing diagnosis system that would allow golfers to employ their own golf clubs, instead of a stick. A need exists for a golf swing training device that allows players to employ their own clubs in a light tracing and reflective system. The Hannaford '608 floor mat also fails to include a reflective surface that indicates a proper swing trace. Therefore, a related need exists for a reflective surface system that orients a golfer to a proper golf club swing trace upon an external surface.

In an ideal golf swing, the golfer maintains an arcing swing of the golf club within a circular plane having the golfer at the center of the circular arc. The plane of the golf swing is neither strictly horizontal nor vertical, but the ideal plane of the golf swing must be inclined to include the position of the golf ball at a low point of the golf swing plane. This low point can be the ground surface, the ball as partially buried below the ground, as in a sand trap, or slightly elevated above the ground surface on a golf tee. A perfect and identically repeatable golf club swing plane is a significant advantage and is universally found in all successful golfers. To perfect a proper golf swing plane in every swing or stroke of the various golf clubs utilized an a typical game or round of golf, the golfer must perfect the golf swing with each of their various golf clubs. Therefore, a need exists for a golf swing training device that uses each of a golfers own particular golf clubs to trace the arc of the ideal golf swing plane.

Another golf swing training device is disclosed in U.S. Pat. No. 3,820,795 to Taylor. Taylor '795 teaches the self analysis of a golf swing that includes observing the tracing of an illuminated light bulb attached to the shaft of a special golf club. The light from the Taylor '795 is directed upward toward the eyes of the golfer. A need exists for a golf swing training device that allows golfers to train and develop their golf swing, and specifically to observe the tracing of light emitted from the golf club, while utilizing their own particular golf clubs.

U.S. Pat. No. 4,693,479 to McGwire shows yet another golf club swing training device. McGwire '479 discloses a golf swing training device having a light beam source that is removably attached to the end of a golf club's grip. The light illuminates a path on the ground surface surrounding the golf ball, to provide a visual indication of the golfer's back swing and forward swing. McGwire '479 only teaches the attachment of the light beam source to the end of the golf club grip. A need therefore exists for a detachable light source system that also employs self contained light that attaches to any standard golf club and allows the golfer to illuminate the ground during all swing positions, rather than only the back swing and the forward swing.

SUMMARY OF INVENTION

The invention provides a method and apparatus for a golf swing training device that comprises a training light adapted to be attachable to a shaft of a golf club. The golf club also includes a head and a grip. The training light is directed to project a head beam of light. The head beam of light projects parallel to the shaft of the golf club, toward the head of the golf club. The training light is also directed to project a grip beam of light. The grip beam of light projects parallel to the golf club shaft, toward the grip of the golf club.

The golf swing training device also includes a swing platform that includes a ground positioned pair of parallel tracks. The parallel tracks includes a stance track and a swing track. The stance track is positioned proximate and parallel to a toe line of the golfer or user of the device, and the swing track is positioned away from, to the front of the golfer. The swing track has a top surface and an optically reflective means attached to the top surface. The optically reflective means reflects the head beam of light as projected by the training light, and reflects the grip beam of light as projected by the training light.

The swing platform optionally includes vertical "swing guide wands," that extend upward on each side of a golfer utilizing the present invention. The swing guide wands aid in maintaining the golfer in a proper position throughout the golf club swing.

The method of the invention includes an initial step of attaching a training light to a shaft of a golf club and projecting a head beam of light and a grip beam of light from the training light. The head beam of light is directed parallel to the shaft of the golf club, toward the head of the golf club and the grip beam of light is directed parallel to the golf club shaft, toward the grip of the golf club.

A swing platform that includes a pair of parallel tracks is positioned on the ground, in front of a user. The parallel tracks includes a stance track and a swing track. An optically reflective means is attached to the top surface of the swing track. The golfer then swings the golf club to reflect the head beam and the grip beam as projected by the training light back to the golfer from the optically reflective means.

The swing platform is preferably adjustable to suit various club lengths and club types. To employ the training device, the golfer stands at one side of the swing platform with the toes of his shoes positioned proximate to one side of the swing platform. The swing platform can also preferably break down for easy storage within a golf bag.

According to an advantage of the invention a golf swing training device is provided that allows golfers to individually train and develop their golf swing, and specifically to observe the tracing of light emitted from the golf club, while utilizing their own particular golf clubs.

According to another advantage of the invention a reflective surface system is provided that orients a golfer to a proper golf club swing tracing upon an external surface.

According to a related advantage of the invention a golf swing training device is provided that uses each of a golfer's own unique golf clubs to trace the arc of the ideal golf swing plane.

According to another advantage of the invention a detachable light source system is provided that also employs a self contained light that attaches to any golf club and allows the golfer to illuminate the ground during all swing positions, rather than only the back swing and the forward swing.

The golfer carries different clubs for each various golf shot, as required during the game. From drivers and woods to irons, wedges and putters, every golf club type and nearly every golf club, has a unique length, weight, head angle and shaft flex, that make a universal practice golf club all but impossible. According to another advantage of the invention, the golfer can utilize any golf club in the present invention. This feature allows the golfers to kinesthetically train their swing with each unique and varried golf club that they will likely employ in a round of golf.

BRIEF DESCRIPTION OF DRAWINGS

FIG. 23 is a partial top view of a golf swing plane training device, according to an embodiment of this invention;

DETAILED DESCRIPTION OF SPECIFIC EMBODIMENTS

The present invention provides a golf swing plane training device and a method for golfers to train and perfect their swinging of a golf club. The device is kinesthetic in that it relies upon golfers' senses of position, movement, tension, velocity and force, to help them learn, ingrain, remember and master the golf swing as taught by the device of the present invention. These kinesthetic senses are specifically as perceived through the golfers' nerve endings within their muscles, tendons and joints. Visual and tactile feedback during the swing allow golfers to modify their swing through self instruction, while the kinesthetic feature of the device reinforces a proper swing technique, which becomes natural and automatic to each individual golfer.

Figure 1:
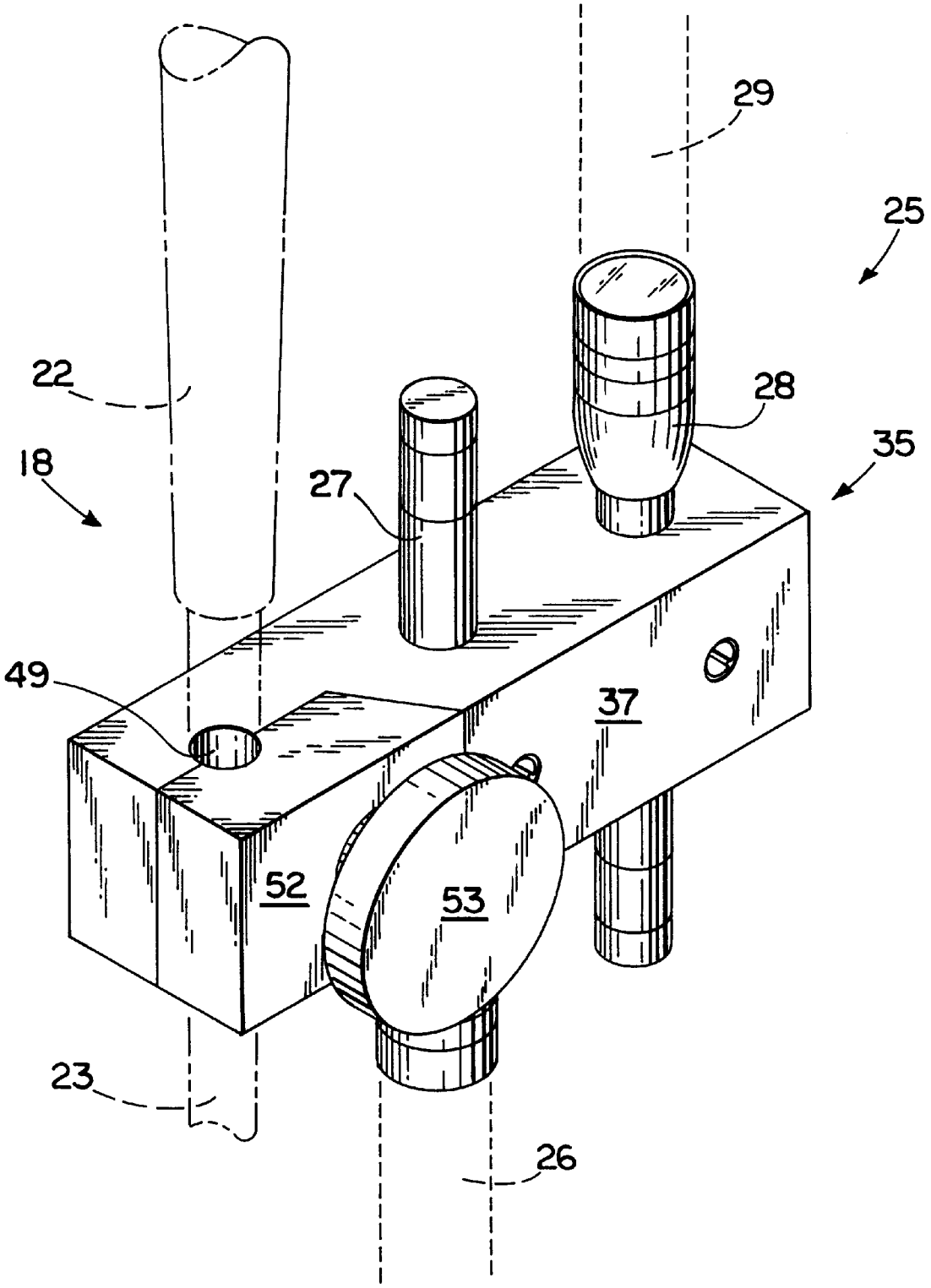
FIG. 1 is a partial perspective view of a golf swing plane training device, according to an embodiment of this invention.
Figure 2:
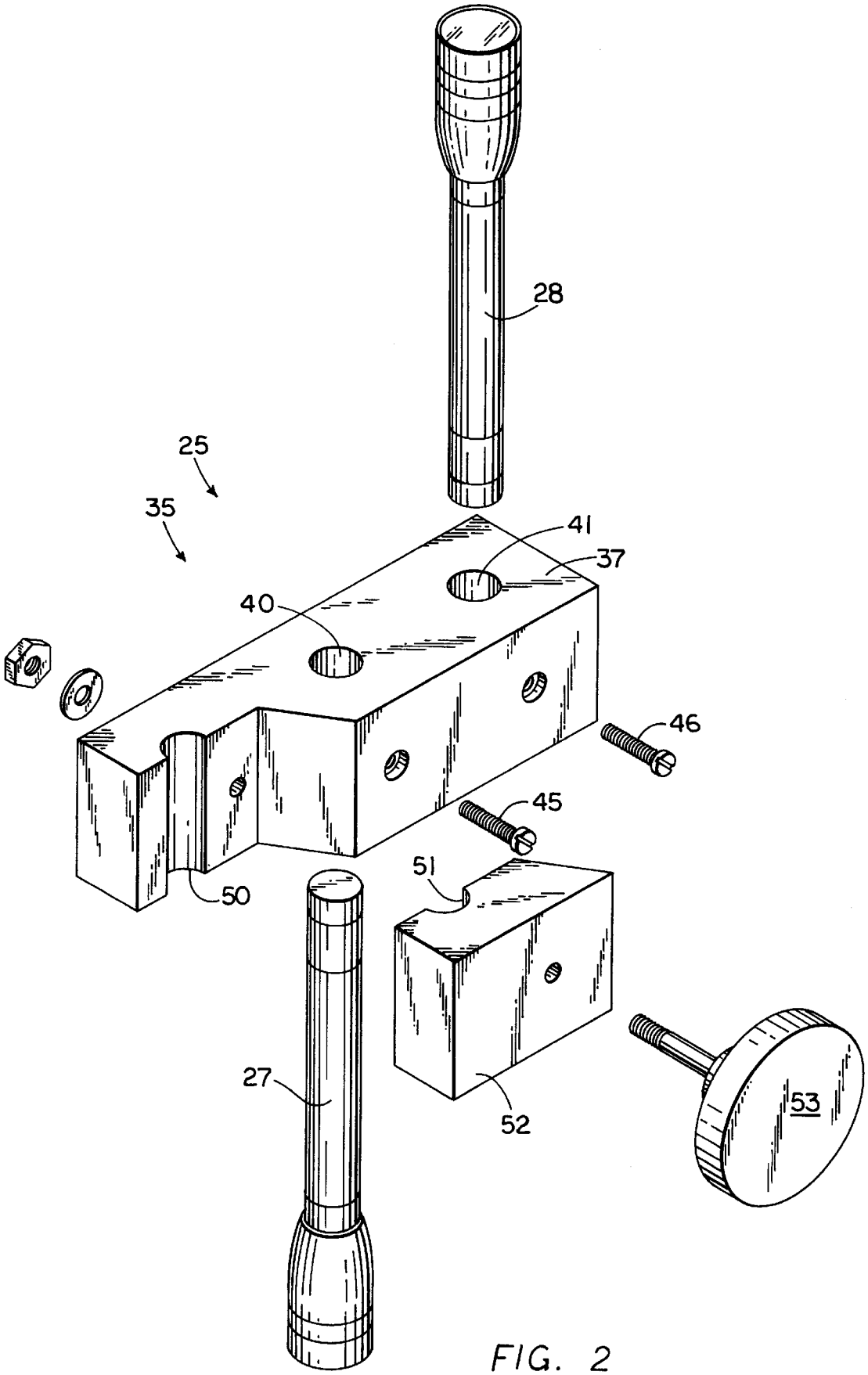
FIG. 2 is an exploded partial perspective view of a golf swing plane training device, according to an embodiment of this invention.

Preferred embodiments of the present invention are illustrated in FIGS. 1 through 32 herein. Specifically, FIGS. 1 through 3 detail a preferred embodiment of a swing plane training light 25, or simply a swing training light, as adapted to be attached to a golf club 18. The golf club is shown being held by a golfer 10 or a user in FIGS. 4 through 10. Conventionally, the golf club includes a head 21 and a grip 22, interconnected by a shaft 23, as detailed in FIG. 5. Preferably, the swing plane training light is removably mountable to the shaft of the golf club, as shown in FIGS. 1 and 2. The swing plane training light includes a shaft mounted light source positioned to illuminate in two directions, preferably with two distinct light sources, both oriented parallel to the shaft of the golf club. A first directional light source of the swing plane training light emits a head beam 26 that is directed to project past the head 21 of the golf club, as shown in FIG. 5. The head beam is preferably emitted from a first light 27, which is shown pointing downward in FIG. 1.

A second directional light source of the swing plane training light 25 is a grip beam 29. The grip beam of light is directed to project past the grip 22 of the golf club, as shown in FIG. 5. Similar to the head beam 26 that emits from the first light 27 of the swing plane training light, the grip beam is preferably emitted from a second light 28, shown pointing upward in FIG. 1.

Figure 3:
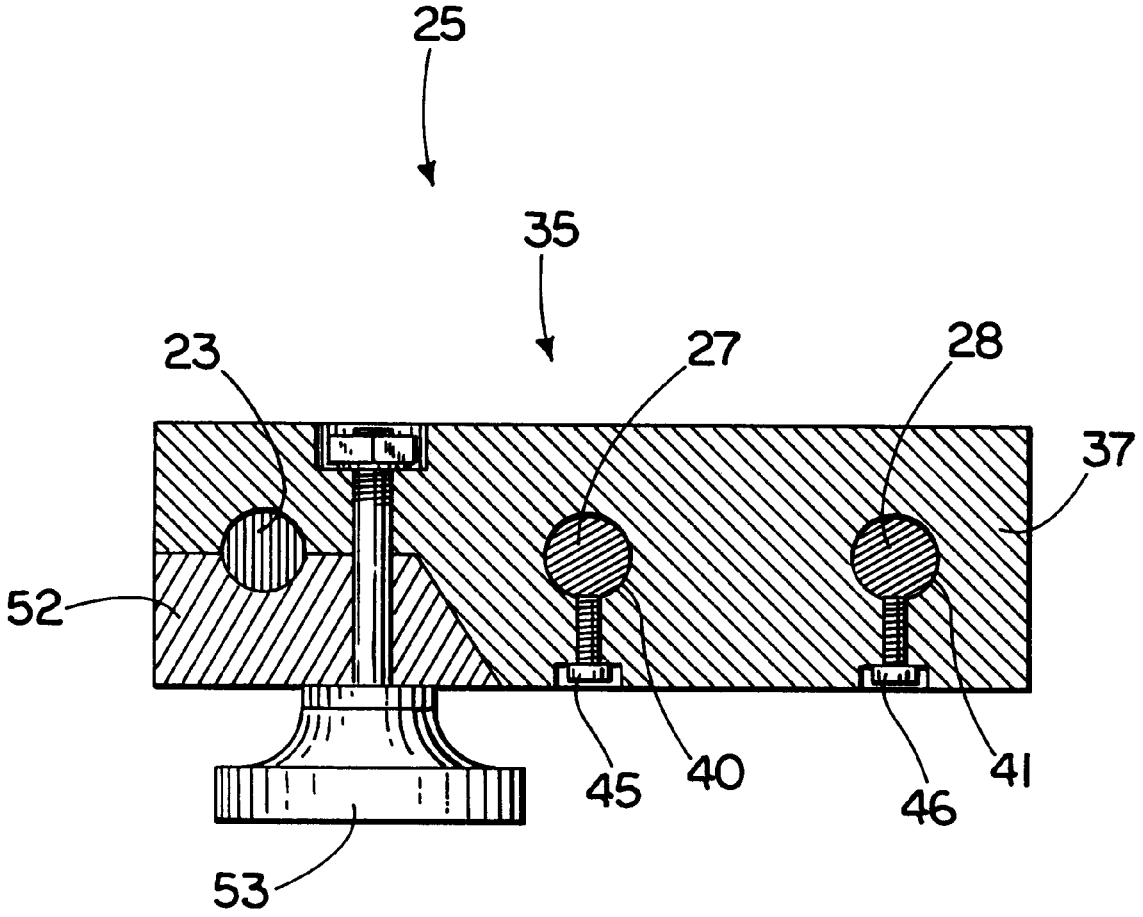
FIG. 3 is a partial sectioned top view of a golf swing plane training device, according to an embodiment of this invention.

The first light 27 and the second light 28 are both preferably flashlights that are similar and small in size, projecting narrow and brightly focused beams of incandescent or flurescent light. Alternatively, a low powered laser is considered as the first light and/or the second light. Also alternatively, a single flashlight or laser having a beam projecting from both ends of the same flashlight device, thereby combining the first light and the second light into a single flashlight is also considered by the inventor, In a preferred embodiment of the swing plane training light 25 as shown in FIGS. 1 through 3, the first light 27 and the second light 28 are inserted into a clamp 35. As detailed in FIG. 2, the clamp includes a main body 37 and a clamp piece 52. The main body includes a first insert 40 for receiving the first light and a second insert 41 for receiving the second light. The first light, when placed into the first insert, is held in place by the tightening of a first set screw 45. Similarly, when the second light is placed into the second insert, the second light is held in place by the tightening of a second set screw 46.

The clamp 35 of the swing plane training light 25 is removably mountable to the shaft 23 of the golf club 18. The shaft of the golf club is shown in FIG. 5 and in phantom line in FIG. 1. The shaft of the golf club is receivable into the club shaft groove 49 of the main body 37. FIG. 2 shows that the club shaft groove includes a main body groove 50 in the main body and a corresponding clamp piece grove 51 in the clamp piece 52. The clamp piece mates to the main body to securely hold the shaft of the golf club in the club shaft groove when a mounting knob 53 is tightened, preferably by hand, to hold the shaft within the club shaft groove, as shown in FIGS. 1 through 3.

The shaft 23 of the golf club 18 is typically within the range of ¼ inch to ½ inch in diameter. Preferably, the clamp 35 can accommodate this range of shaft diameters to allow golfers to mount the clamp to any club that they desire to train with. This feature enables golfers to train and practice swinging with their own personal golf clubs, thereby improving their technique for the same clubs that the golfers will employ during an actual round of golf.

Figure 4:
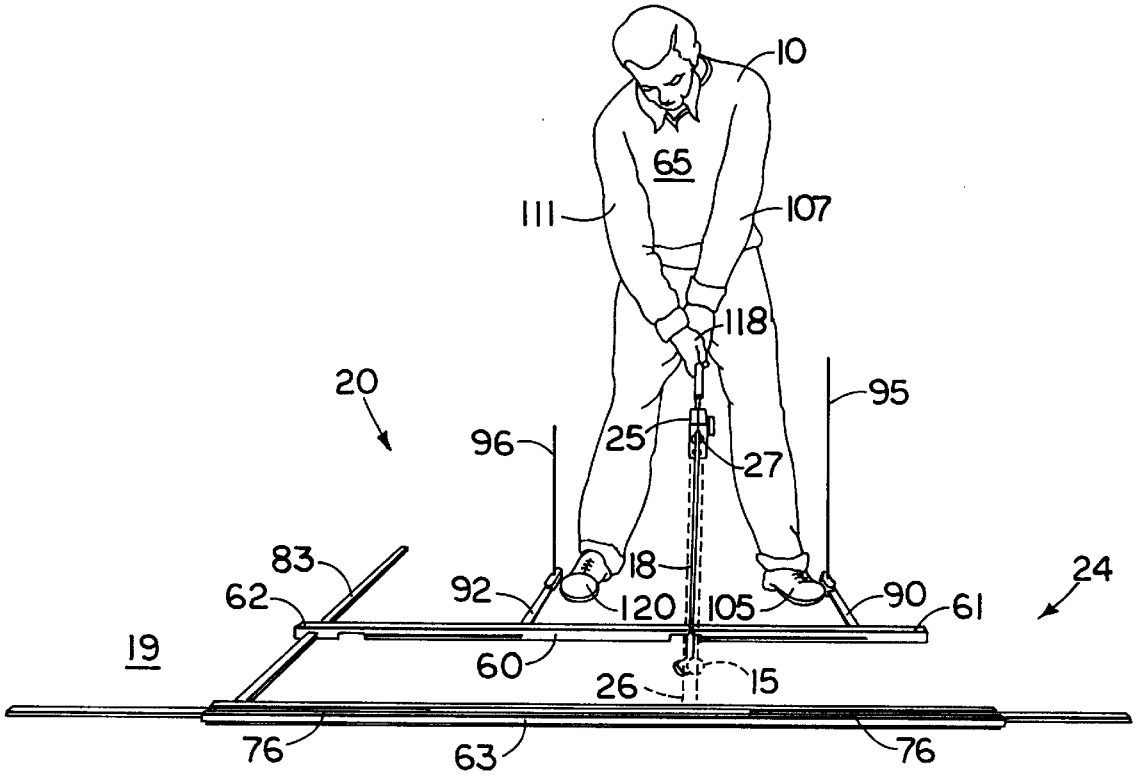
FIG. 4 is a frontal perspective view of a golf swing plane training device, according to an embodiment of this invention.
Figure 5:
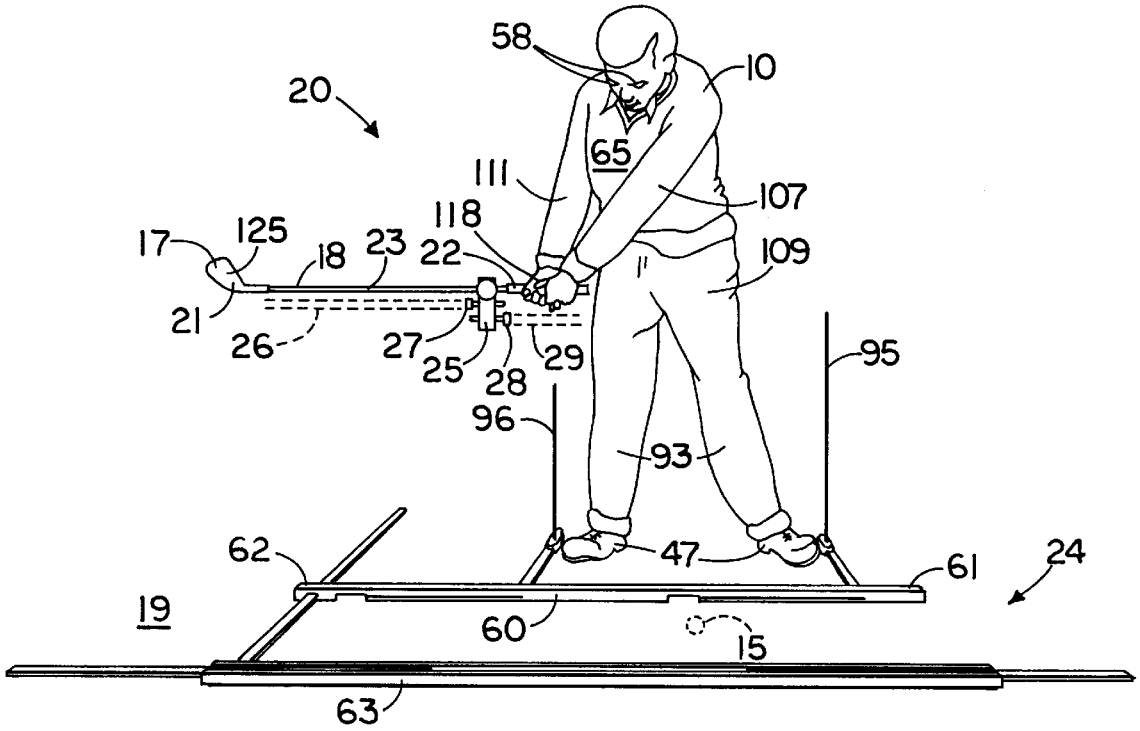
FIG. 5 is a frontal perspective view of a golf swing plane training device, according to an embodiment of this invention.

FIGS. 4 through 10 show the golfer 10 employing a swing plane training device 20 of the present invention. FIG. 4 shows the golfer at the position of addressing a practice golf ball 15 with the golf club 18 while employing the golf swing plane training device 20. The golf swing training device preferably includes a pair of parallel tracks 24 positioned on a ground surface 19, also referred to herein as a swing plane platform, or simply a swing platform. The golf swing training device also includes the swing plane training light 25 attached to the golf club.

As detailed herein in the method of the present invention, preferably, the standard golf ball is not utilized when the training light 25 is employed. A golf ball position indicator, which can be a simple coin or marker, or a light weight, practice golf ball 15, as shown in FIGS. 4 through 11, should be utilized to avoid a flexing of the shaft 23 of the golf club 18 that typically occurs in a impact with a standard golf ball. This shaft flex could dislodge the clamp 35 of the swing plane training light or damage the golf club.

The golf club utilized with the swing plane training device 20 is of conventional design and includes a head 21, for impacting the golf ball, and a grip 22 for holding the golf club. The head and the grip are connected by a shaft 23 as shown in FIGS. 4 through 14. The head of the golf club includes a toe 17 as shown in FIG. 5.

A preferred orientation of the clamp 35 on the 23 shaft of the golf club 18 is clearly shown in FIGS. 4 and 5. The clamp of the swing plane training light 25 is preferably oriented perpendicular to the attached shaft. The clamp is also preferably oriented in an approximately opposite direction to the direction of the head 21 of the golf club. This preferred orientation of the clamp allows the head beam 26 of light to project beyond the head of the golf club without obstruction.

The clamp 35 of the swing plane training light 25, in a preferred embodiment as shown in FIG. 5, also serves to extend the second light 28 parallel to and away from the shaft 23 of the golf club 18 by a minimum separation distance. The minimum separation distance is defined herein as the distance required to ensure the grip beam of light is not interfered with or obstructed during the golf swing by the hands of the golfer clasping the grip of the golf club.

Figure 11:
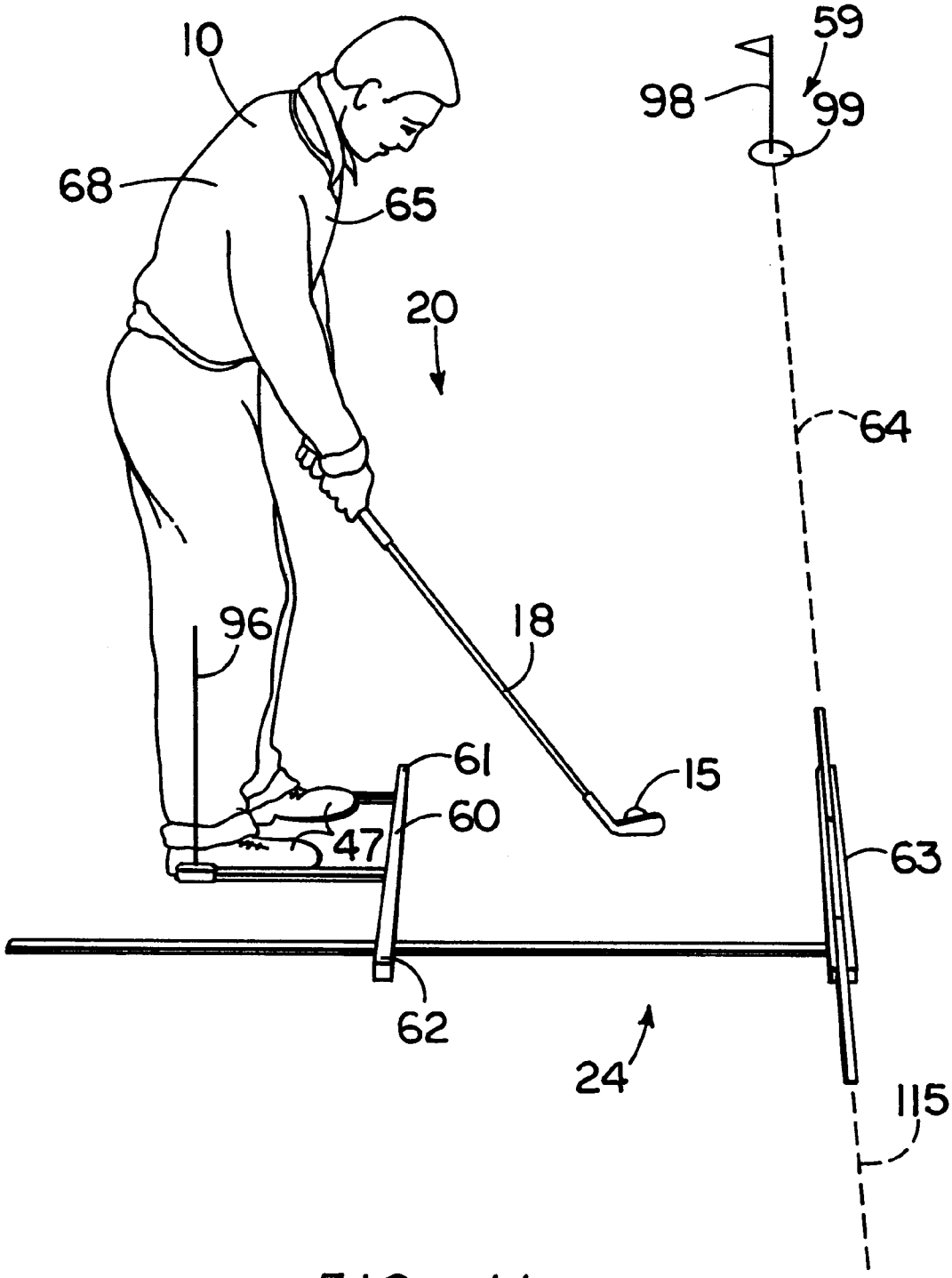
FIG. 11 is a rearward side perspective view of a golf swing plane training device, according to an embodiment of this invention.
Figure 15:
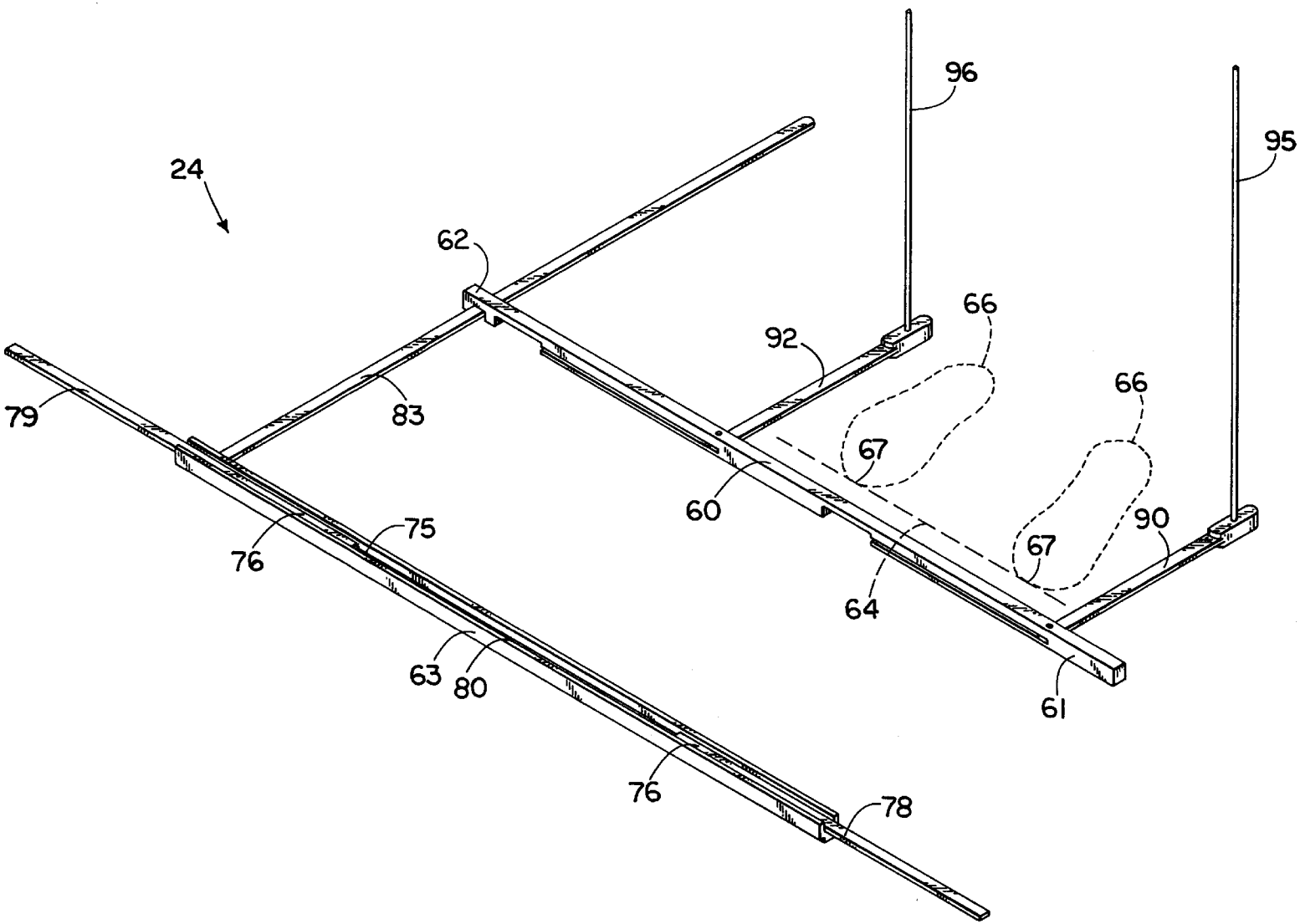
FIG. 15 is a partial perspective view of a golf swing plane training device, according to an embodiment of this invention.
Figure 16:
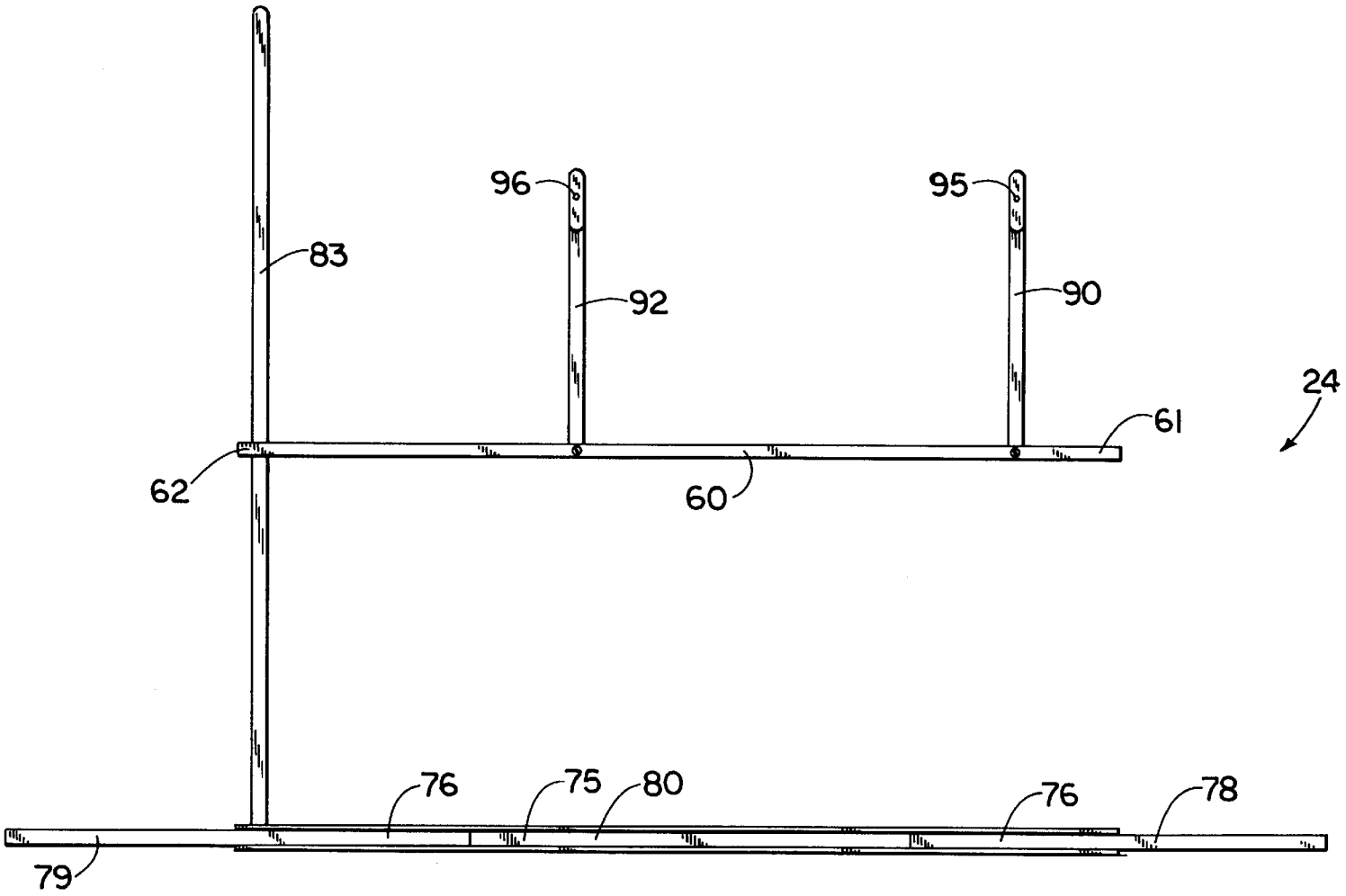
FIG. 16 is a partial top view of a golf swing plane training device, according to an embodiment of this invention.

The grip beam 29 that projects from the second light 28 is preferably unobstructed by the hands of the golfer positioned on the grip 22 of the golf club 18. The unobstructed grip beam can contact the pair of parallel tracks 24 positioned on the ground 19. FIGS. 15 and 16 show the ground positioned pair of parallel tracks 24 of the present invention. Specifically, as shown in FIG. 11, the swing plane platform 24 includes a stance track 60 for positioning the feet 47 of the golfer 10, and a swing track 63. The stance track includes a forward stance end 61 and a rear stance end 62. The swing track orients the golfer relative to a target 59 and serves to reflect the head beam 26 and the grip beam 29 back to the eyes 58 of the golfer.

When the golfer 10 is in a proper position to begin the swing or stroke of the golf club 18, as shown in FIG. 4, the stance track 60 of the swing plane platform 24 is preferably positioned proximate to and parallel to a toe line 64. The outline 66 of the feet 47 of the golfer are shown in FIGS. 15 and 16. The toe line 64, as defined herein, is an imaginary line that can be drawn between the feet of the golfer at the position of the golfer's toes 67. The toe connects the toes of the golfer's two feet. The toe line moves toward or away from the target line in response to the height of the golfer and the length of the golf club.

As shown in FIG. 4, in a preferred embodiment of the present invention, the swing track 63 of the swing plane platform 24 is positioned on a target line 64, as shown in FIG. 11. The target line 64, as herein defined, is an imaginary line that is preferably follows an extension of the swing track 63 away to the front 65 of the golfer 10 and further extends to the target 59. The golf ball and the target always lie along the imaginary target line and the target line never moves during a particular golf shot. The target can include a flag 98. As herein defined the target is the point that the golfer aims to place the golf ball. The flag typically marks the location of a cup 99 or hole, the cup being the golfer's ultimate destination of the golf ball, at the end of each golf course link. However, the target can be the hole, the cup, the flag or a point that is real or imagined. The imagined target is typically employed by the golfer on a driving range or when the flag or the cup cannot be reached in a particular shot or is obstructed from the view of the golfer. Importantly, in both the drive golf shot and the putt golf shot, the target line is always parallel to the toe line 64. In the draw shot or the fade shot, the target line becomes the draw line 145 or the fade line 155, respectively, each intersecting with the toe line, as herein later discussed in a method of the present invention.

The swing track includes a forward target end 66 and a rearward target end 67. The swing track also includes a top surface 75 that preferably includes an optically reflective element 76 attached to the top surface. The optically reflective element reflects light projected from the training light 25. When the first light 27 or the second light 28 strikes the optically reflective element, light reflects back to the eyes 58 of the golfer 10 employing the present invention. Most preferably, two optically reflective elements, a forward element 78 and a rear element 79 are included, as shown in FIGS. 15 through 19.

Figures 29, 30, 31:
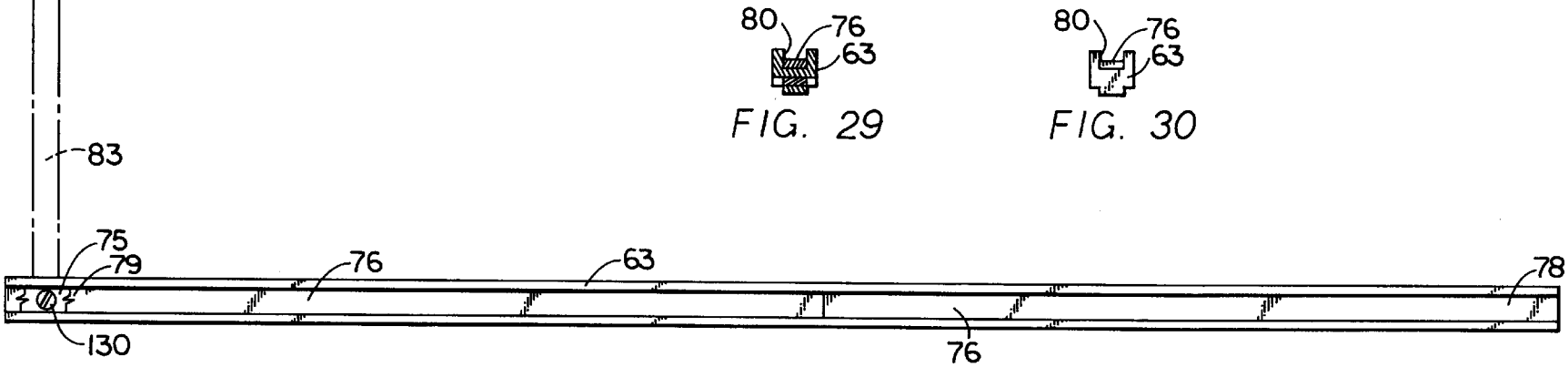
FIG. 29 is a partial sectional end view of an improved golf swing plane training device, according to an embodiment of this invention.
FIG. 30 is a partial end view of a golf swing plane training device, according to an embodiment of this invention.
FIG. 31 is a partial top view of a golf swing plane training device, according to an embodiment of this invention.

The forward element 78 and the rearward element 79 of the most preferred embodiment of the optically reflective element 76, can slide within a channel 80, which are preferrably included in the top surface 75 of the swing track 63. FIGS. 29 and 30 detail the channel within the swing track.

Figure 32:
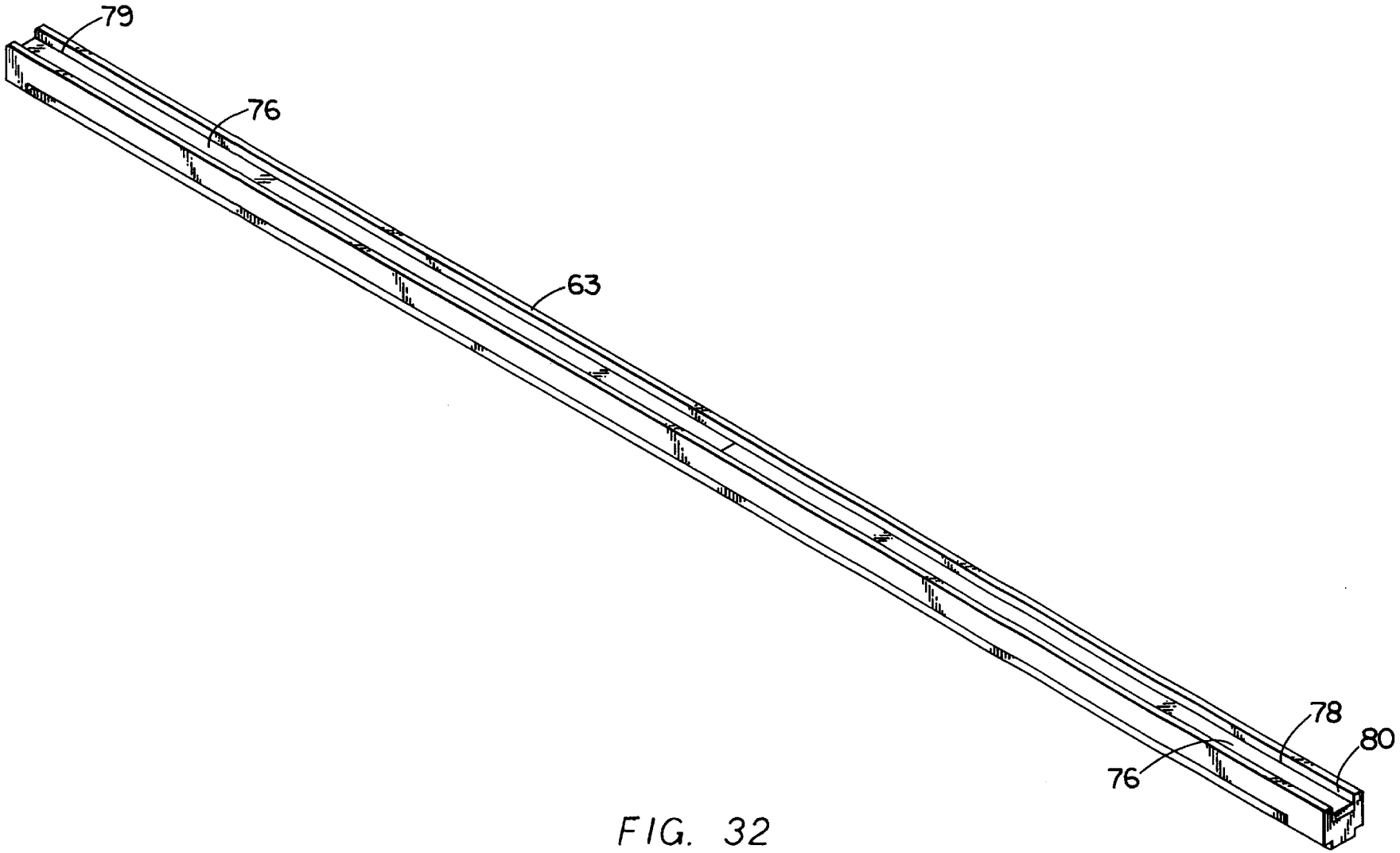
FIG. 32 is a partial perspective view of a golf swing plane training device, according to an embodiment of this invention.

To set up the present invention from a stored position as shown in FIG. 32, the forward element 78 slidably extends forward from the channel 80 in the swing track 63. Similarly, the rear element 79 slidably extends rearward from the channel in the swing track. The forward element can be retracted into the swing track for convenient storage. Similarly, the rearward element can be retracted into the swing track.

The forward element 78 and the rear element 79 of the optically reflective element 76 can be any conventional reflective material or product. The preferred optically reflective element is a plastic "prismatic" reflector strip as typically utilized for bicycle and automotive reflectors. Alternatively, reflective fabric or tape, as is typically utilized in jogging clothing and road signs, is also considered for use as the optically reflective element.

A connector bar 83 connects the swing track 63 to the stance track 60 as shown in FIGS. 4 through 11, 15, 16 and 31. As detailed in FIG. 31, the connector bar is preferably attached to the swing track with a pivotable connection 85, most preferably a screw 86, as the detail of FIG. 32 shows. As specifically shown in FIG. 15, the connector bar is also receivable into a connector channel 88 in the rear end 94 of the stance track.

In a preferred embodiment of the present invention, the connector bar 83 slidingly connects to the stance track 60. The ground 19 positioned pair of parallel tracks 24 is preferably adjustable to suit various club lengths and club types.

Because of the adjustments intrinsic to the apparatus of the present invention as described, golfers 10 of any height, employing any conventional golf club 18, can use this device. The separation between the swing track 63 and the stance track 60 is adjustable to accommodate any desired golf club length.

In another preferred embodiment of the present invention, additional aids are included in the swing plane training device 20 to help the golfer 10 maintain a proper position during the swing of the golf club 18. As shown in FIGS. 4 through 19 and detailed in FIGS. 20 and 23 through 28, the stance track 60 of the swing plane platform 24 preferably includes a forward guide 90 and a rear guide 92. The forward guide extends from near the forward stance end 61 of the stance track at preferably a right angle toward the golfer, as shown in FIGS. 4 and 15. Similarly, the rear guide extends toward the golfer, substantially perpendicular to the stance track and affixed near the rear stance end 62 of the stance track.

As also shown in FIGS. 5 and 15, a forward wand 95 extends vertically from the forward guide 90 of the stance track 60. Similarly, a rear wand 96 extends vertically from the rear guide 92 of the stance track. If the legs 93 of the golfer 10 stray beyond the forward wand or the rear wand during the golf stroke, or swing of the golf club 18, the forward wand and the rear wand provide a physical contact to the legs of the golfer.

The method of the present invention comprises setting up the swing training device 20 as desired for the selection of a specific golf club 18 and the selection of a specific type of stroke or swing of the golf club. After the swing plane training device is properly configured, the golfer executes a series of steps or positions that combine in a smooth motion to result in a well executed swing or stroke.

Preferably, to take full advantage of the swing plane training light 25, the swing plane training device 20 is used under subdued light or a darkened room. After repeatedly utilizing the swing plane training device in darkened conditions, in the configurations as shown in FIGS. 4 through 11, the golfer is ready to employ the swing plane platform, without the swing plane training light, during a round of golf or at a driving range, utilizing a standard golf ball.

To properly employ the swing plane training device 20 the golfer 10 must first set up the device, properly positioning the swing plane platform 24, the golf ball 15, the golf club 18, and the golfer's body. The set-up of the swing training device 20 includes attaching the swing plane training light 25 to the shaft 23 of the golf club 18. The swing plane training light preferably projects the head beam 26 and the grip beam 29. The swing plane training light is attached to the shaft of the golf club, preferably with the clamp 35 as shown in FIG. 1. The golfer directs the head beam parallel to the shaft of the golf club, toward the head 21 of the golf club, and directs the grip beam parallel to the golf club shaft, toward the grip 22 of the golf club.

Next, the pair of parallel tracks of the swing plane platform 24 are positioned on the ground 19. The pair of parallel tracks are positioned in front of the golfer, as shown in FIG. 4. The parallel tracks include the stance track 60 and the swing track 63. The stance track is positioned proximate and parallel to the toe line 64. The swing track is positioned on the target line 64, as shown in FIG. 11, parallel to the stance track 60 and positioned away from the front 65 of the golfer.

The forward direction to the golfer 10 is herein defined as the direction leading toward the target 59, in which the golfer will attempt to propel the golf ball 15. The forward side of the golfer, as defined herein, is the side of the golfer oriented toward the target 59. Similarly, the direction to the rear of the golfer as defined herein is the direction opposite to the forward direction, or equivalently defined as the side of the golfer oriented in the opposite direction from the target. FIG. 11 is a perspective from the rear of the golfer.

The golfer 10 has a back 68 to the opposite from the front 65, as shown in FIG. 11. Behind the golfer is a direction to the back of the golfer, opposite a direction to the front of the golfer. A facing direction is the direction viewed in FIGS. 4 through 10. The facing direction as herein defined, is towards the front of the golfer.

Preferably, as shown in FIG. 11, in a view from the rear of the golfer 10, the golf ball 15 is preferably positioned midway between the pair of parallel tracks 24. Also preferably, when viewed in the facing direction, as shown in FIG. 4, the golf ball is positioned at the middle point of the golfer's stance. This golf ball position is preferred when the golfer's shorter irons or a putter are utilized, while the golf ball is preferably aligned with the instep of the golfer's forward foot 105 when the golfer swings a driver or a wood.

After the swing training device 20 is properly configured and the golfer 10 and the golf ball 15 are in position, the golfer is ready to address the golf ball and begin the actual golf swing. A front view of the address position is as shown in FIG. 4. As shown in FIG. 4, the golfer's forward arm 107 and the golf club 18 are in a straight line, with the golf club to the center of the golfer as shown in FIG. 4, or slightly over a forward hip 109 of the golfer. A view from the rearward side is shown in FIG. 11. As shown in FIG. 11, the golfer's back 68 is straight and the golfer's forward arm and rear arm 111 both extend vertically downward. The swing plane training device can be retrofitted to any conventional golf club by clamping the main body 37 of the swing plane trainer to the selected golf club and orienting the light source, preferably a first light 27 and a second light 28 of the swing plane training light to project both toward the head 21 and toward the grip 22 of the golf club.

To implement the golf swing training device 20 of the present invention, the golfer 10 stands at one side of the ground 19 positioned pair of parallel tracks 24, as shown in FIG. 11, with the toes 67 of his feet 47 positioned proximate to the stance track 60. The swing track is preferably positioned on the ground 19, at a location opposite the ball 15 in relation to the golfer and the stance track.

As shown in FIG. 1, the shaft 23 of the golf club 18 is fitted with the swing plane trainer 25. The swing plane trainer emits light along the shaft of the golf club. When a golfer 10 swings the golf club while employing the swing plane training device 20, the golfer can observe light projections from the swing plane trainer and can visually follow the path of the lights that reflect back from the swing track 63.

The reflection of light back from the swing track 63 is preferably achieved by attaching an optically reflective element 76 to the top surface 75 of the swing track 63. The golfer 10 can swing the golf club 18 to reflect the head beam 26 of light or the grip beam 29 of light off of the optically reflective element.

The first step of the swing or stroke is the address position, as previously described herein above. The address position is a resting position, in which the golfer 10 remains still, focusing on the swing to be initiated.

After addressing the ball, the golfer 10 begins the golf swing with a back swing, followed by a downswing. At the bottom of the downswing, the golfer strikes the golf ball 15 with the head 21 of the golf club 18.

With the golf swing training device 20 of the present invention, golfers can train their golf swing, or stroke, in a detailed series of steps. The individual golfer monitors each step and smoothly combines the incremental steps into a perfected swing.

To begin the stroke from the address position, the golfer 10 begins to swing the golf club 18 up and toward the rear of the golfer, to achieve a backswing ground parallel position, as shown in FIG. 5. In the backswing ground parallel position, the shaft 23 of the club is parallel to the ground 19. The head beam 26 of the first light 27, as attached to the shaft of the golf club, projects directly rearward from the golfer, proximately following a rear extension 115 of the target line 64.

In a properly initiated swing of the golf club 18, the head beam 26 from the first light 27 follows the optically reflective element 76 on the swing track 63 rearward, as the golf club swings to the rear of the golfer 10. At the backswing ground parallel position, a mirror (not shown), can optionally be placed directly to the rear of the golfer. The mirror reflects the head beam back to the golfer. This reflected head beam provides the golfer with direct feedback to properly establish the proper backswing ground parallel position.

Again referring to FIG. 5, which shows the backswing ground parallel position of the golf swing, the toe 17 at the head 21 of the golf club 18 should point straight upward and the shaft 23 of the club should be directly over the stance track 60. The proper backswing ground parallel position also requires that the grip beam 29 of the second light 28 is directed to point at the forward hip 109 of the golfer 10.

Figure 6:
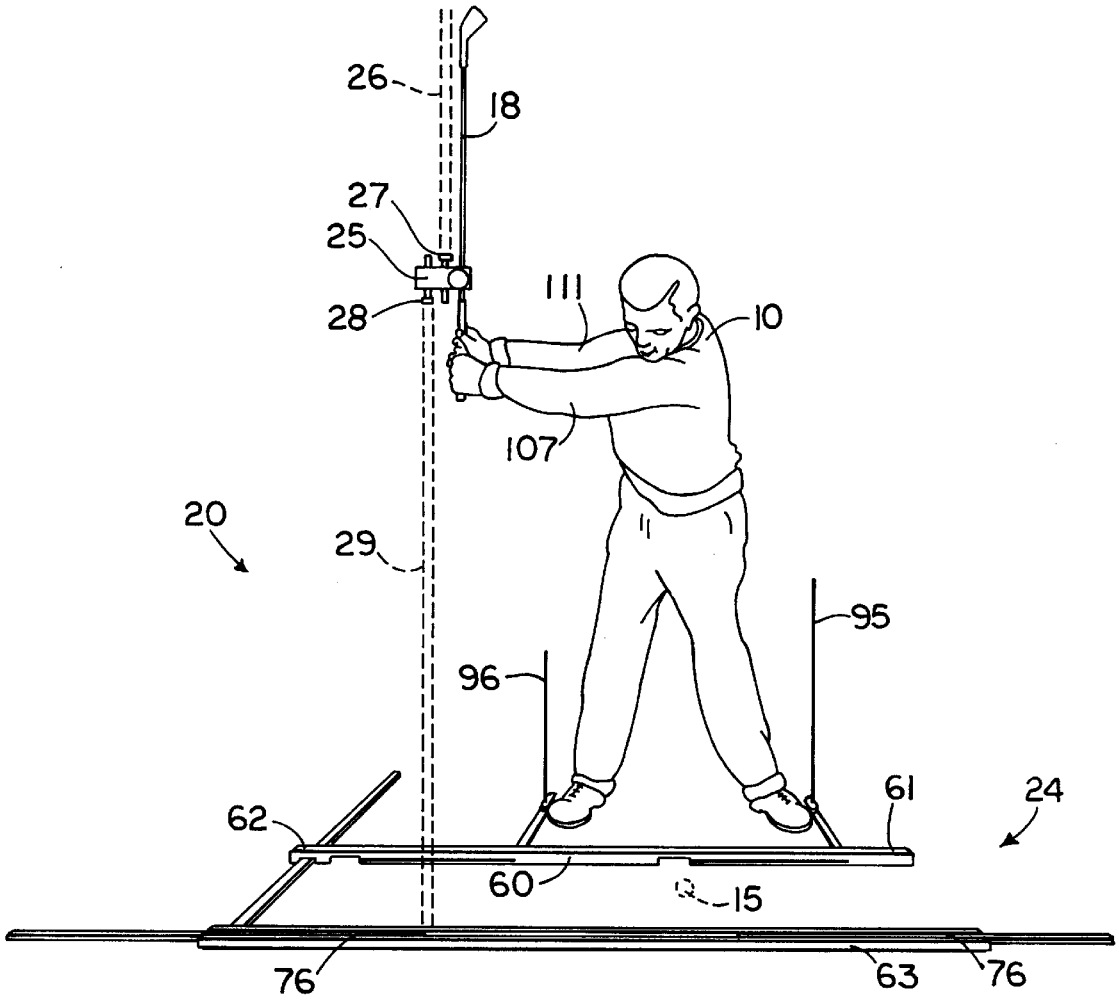
FIG. 6 is a frontal perspective view of a golf swing plane training device, according to an embodiment of this invention.

The next position of the backswing of the golf club 18 is a mid-backswing position, as illustrated in FIG. 6. In the mid-backswing position, the forward arm 107 of the golfer 10 is straight and parallel with the ground 19. The shaft 23 of the golf club extends straight up, forming a 90° angle with the forward arm. The grip beam 29 from the second light 28 projects directly down to the target line 64 and reflects off of the optically reflective element 76 to the eyes 58 of the golfer. This reflected grip beam provides the golfer with direct feedback to properly establish the proper mid-backswing position.

Figure 7:
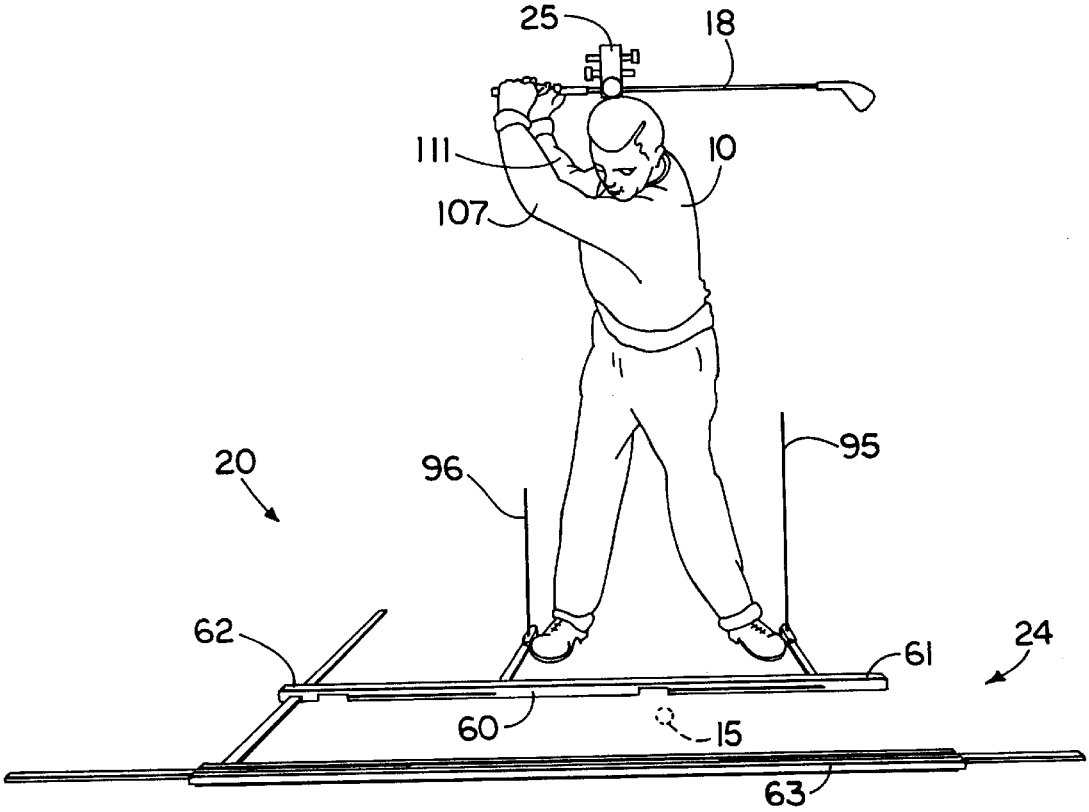
FIG. 7 is a frontal perspective view of a golf swing plane training device, according to an embodiment of this invention.

The golfer 10 now continues the backswing of the golf club 18 to a top of the backswing position, as shown in FIG. 7. In the top of the backswing position, the golf club is parallel to the ground 19 and also lies parallel to the stance track 60 and the target line 64. The optional mirror (not shown), positioned directly to the rear of the golfer, proximate to the rear extension 115 of the target line 64, can reflect the grip beam 29 of the second light 28, back to the eyes 58 of the golfer 10. This reflected grip beam provides the golfer with direct feedback to properly establish the proper top of the backswing position. Additionally, in the top of the backswing position, the head beam 26 from the first light 27 projects directly forward from the golfer.

From the top of the backswing, the golfer 10 begins the downswing. The mid-downswing position is equivalent to the mid-backswing position as shown in FIG. 6. In the mid-downswing position, the forward arm 107 of the golfer is straight and parallel with the ground 19. The shaft 23 of the golf club 18 extends straight up, in a vertical position, at a 90° angle with the forward arm. The grip beam 29 from the second light 28 projects directly down to the swing track 63.

By maintaining the golf club straight up, in the vertical position, the golfer avoids a stroke that is too flat or too steep. The flat stroke will likely top the golf ball 15 or miss the golf ball completely because the plane of the swing is above the golf ball. The steep stroke will likely undercut the golf ball because the plane of the swing is below the golf ball. The "plane of the swing" or "swing plane", as herein defined, is a two dimensional area that the golf club scribes during the swing. A flat stroke corresponds with a flat swing plane that tends to the horizontal. A steep stroke corresponds to a steep swing plane that tends to the vertical.

The downswing ground parallel position is shown in FIG. 5, and is equivalent to the backswing ground parallel position. In the downswing ground parallel position the club shaft 23 is parallel to the ground 19. The head beam 26 of the first light 27 attached to the shaft of the golf club, projects directly to the rear of the golfer 10, following the rear extension 115 of the target line.

At the downswing ground parallel position, the mirror (not shown), is optionally placed directly to the rear of the golfer 10. The mirror reflects the head beam 26 back to the golfer, providing the golfer with direct feedback to establish the proper ground parallel position.

Referring again to FIG. 5, in the downswing ground parallel position, the toe 17 of the golf club 18 should point straight upward and the shaft 23 of the golf club should be substantially parallel to and directly over the stance track 60. The proper downswing ground parallel position also requires that the grip beam 29 of the second light 28 is directed to point at the golfer's forward hip 109. The hands 118 of the golfer should be directly above the outside of the rear foot 120 of the golfer.

As the golf club 18 continues the downswing, the golf ball 15 is impacted. FIG. 4 shows the impact position, which is similar to the address position as described herein above. In the impact position, as with the address position, the forward arm 107 and golf club approximately form a straight line. As the golf ball is impacted, the hands 118 of the golfer 10 move over the forward hip 109. The head beam 26 continues to follow the target line 64.

Figure 8:
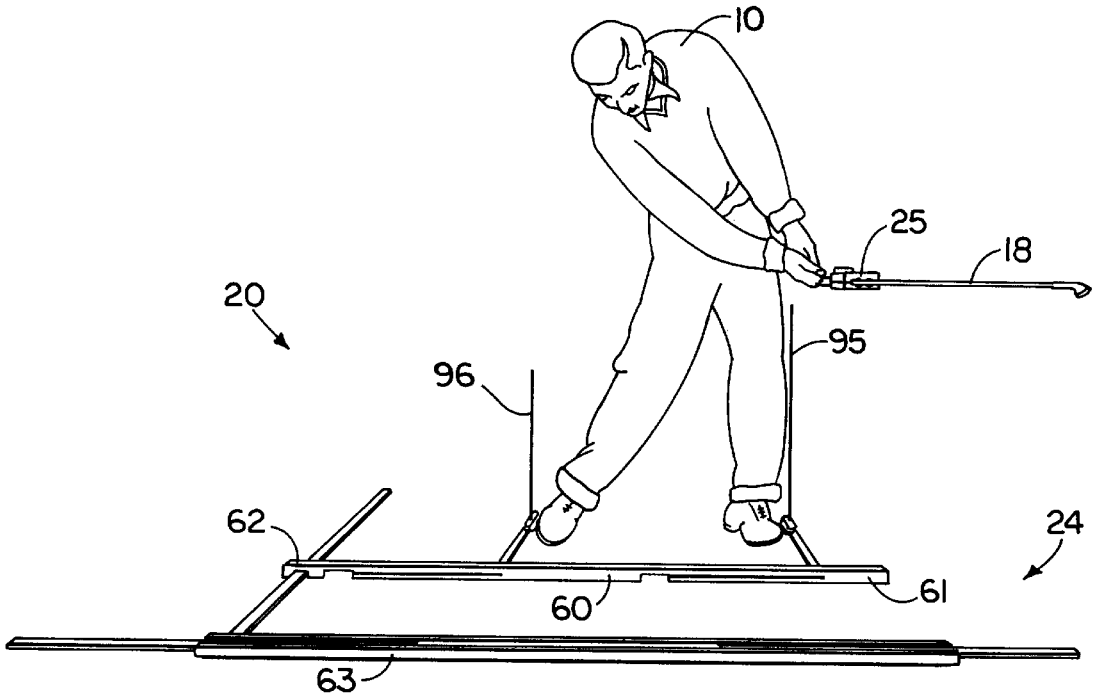
FIG. 8 is a frontal perspective view of a golf swing plane training device, according to another embodiment of this invention.

After the golf ball 15 is impacted, the golf club 18 continues in a foreswing motion to the foreswing ground parallel position as shown in FIG. 8. The foreswing ground parallel position is a mirror image of both the downswing ground parallel position and the backswing ground parallel position. In the foreswing ground parallel position the toe 17 of the golf club points straight upward. Additionally, the golf club is parallel to and directly above the stance track 60. The hands 118 are directly above the forward side of the forward foot 105. In the foreswing ground parallel position the head beam 26 points directly forward, after following the target line 64 to the target 59.

Figure 9:
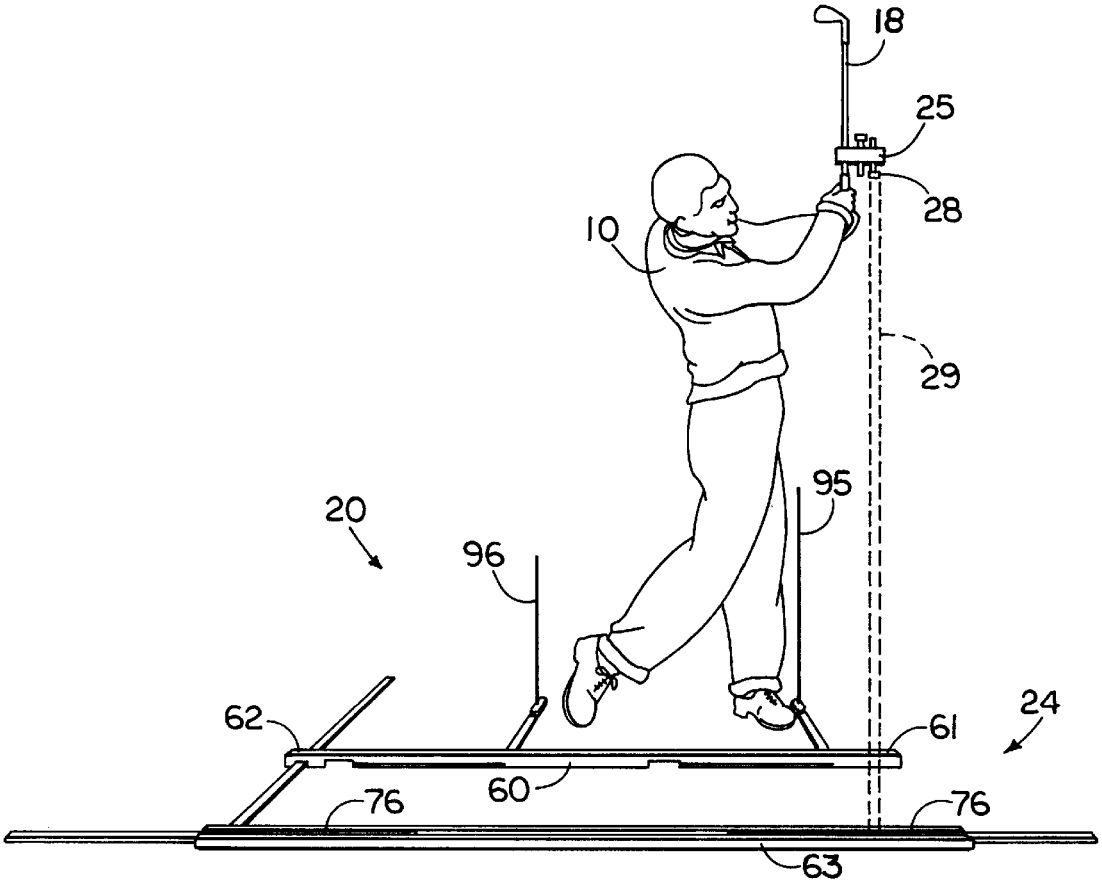
FIG. 9 is a frontal perspective view of a golf swing plane training device, according to an embodiment of this invention.

The foreswing motion of the golf club 18 continues to the mid-foreswing position, as shown in FIG. 9. The mid-foreswing position is a mirror image of both the mid-downswing position and the mid-backswing position. In the mid-foreswing position, the rear arm 111 of the golfer 10 is straight and parallel with the ground 19. Additionally, the shaft 23 of the golf club 18 extends vertically straight up at to forms a 90° angle with the forward arm. The rear arm 111 of the golfer is slightly bent at the elbow. In the mid-foreswing position, the grip beam 29 projects to the forward element 78 of the swing track 63.

Figure 10:
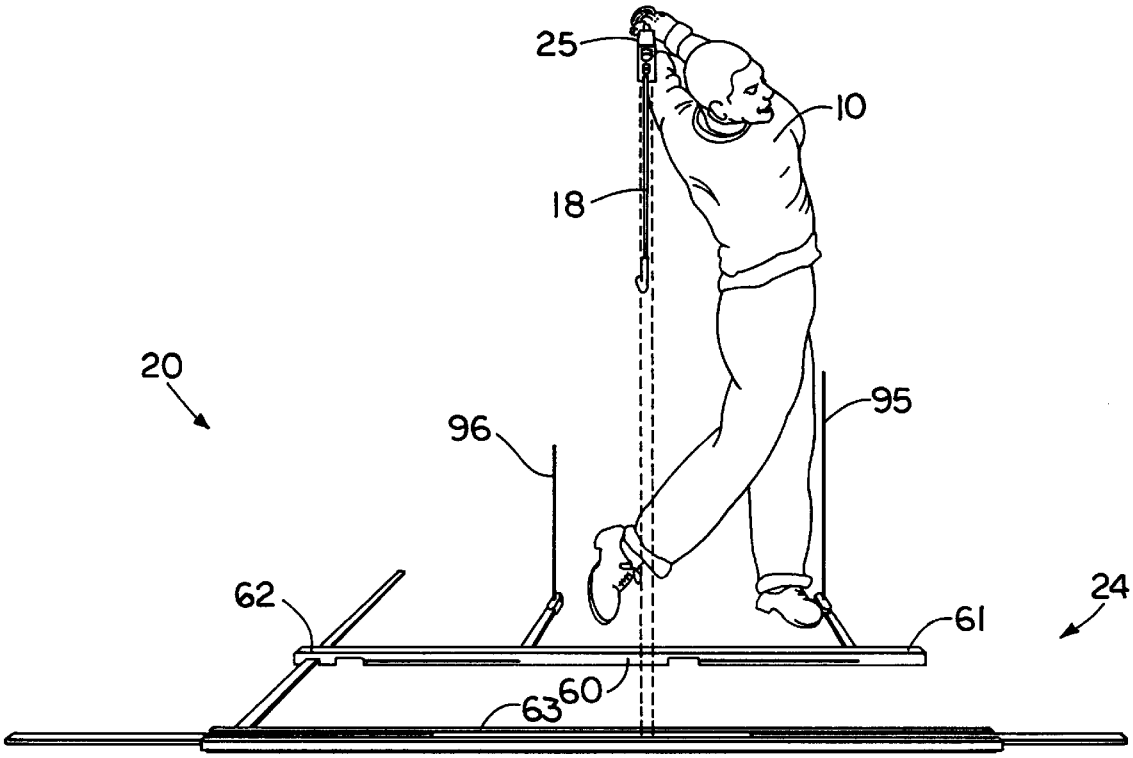
FIG. 10 is a frontal perspective view of a golf swing plane training device, according to an embodiment of this invention.

The foreswing motion of the golf club 18 ends in the finish position as illustrated in FIG. 10. In the finish position, the hands 118 of the golfer 10 are to the rear of golfer's head. Also as shown in FIG. 10, stoke finishes with the shaft 23 of the golf club extending over the golfer's rear shoulder, and directed proximately downward. Additionally in the finish position, the grip beam 29 projects to the swing track 63 of the target line 64 at approximately the swing's point of contact with the golf ball 15. The toe 17 of the golf club 18 points behind the golfer and rear foot 120 of the golfer naturally pivots to allow the golfer to face the forward direction, while the forward foot's heel lifts off the ground 19.

To best utilize the swing plane training device 20 of the present invention, the golfer should preferably begin training under subdued lighting with the swing plane training light in conjunction with the swing plane platform as herein above specified. By first training without the standard golf ball, but with a marker as preferred, the full and smooth swing plane is perfected. To obtain kinesthetic benefits from the device and achieve changes in muscle memory, approximately 35 practice sessions of approximately 20 minutes each are preferably employed before utilizing the swing plane platform without the swing plane training light. Once the muscle memory is obtained from employing the swing plane training device, the standard golf ball can be utilized in conjunction with the swing plane platform, without the swing plane training light, on the driving range or golf course.

Besides the drive, other golf shots can be perfected by employing the swing training device 20 of the present invention. A "draw" is a finesse golf shot utilized to curve the trajectory of the golf ball 15 around an obstacle blocking the desired target 59. The draw shot is a controlled or intentional hook. The hook can be defined as an unintentional trajectory of the golf ball toward the back or behind the golfer 10. Most golfers have great difficulty in perfecting an accurate and controlled draw shot.

Figure 12:
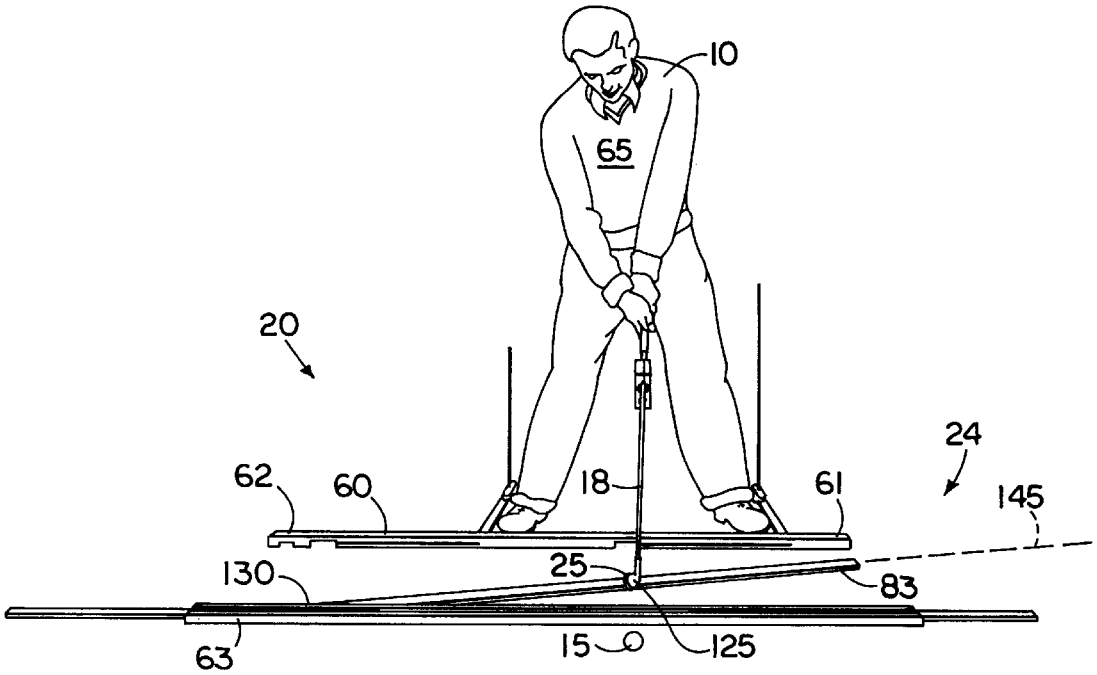
FIG. 12 is a frontal perspective view of a golf swing plane training device, according to an embodiment of this invention.
Figure 18:
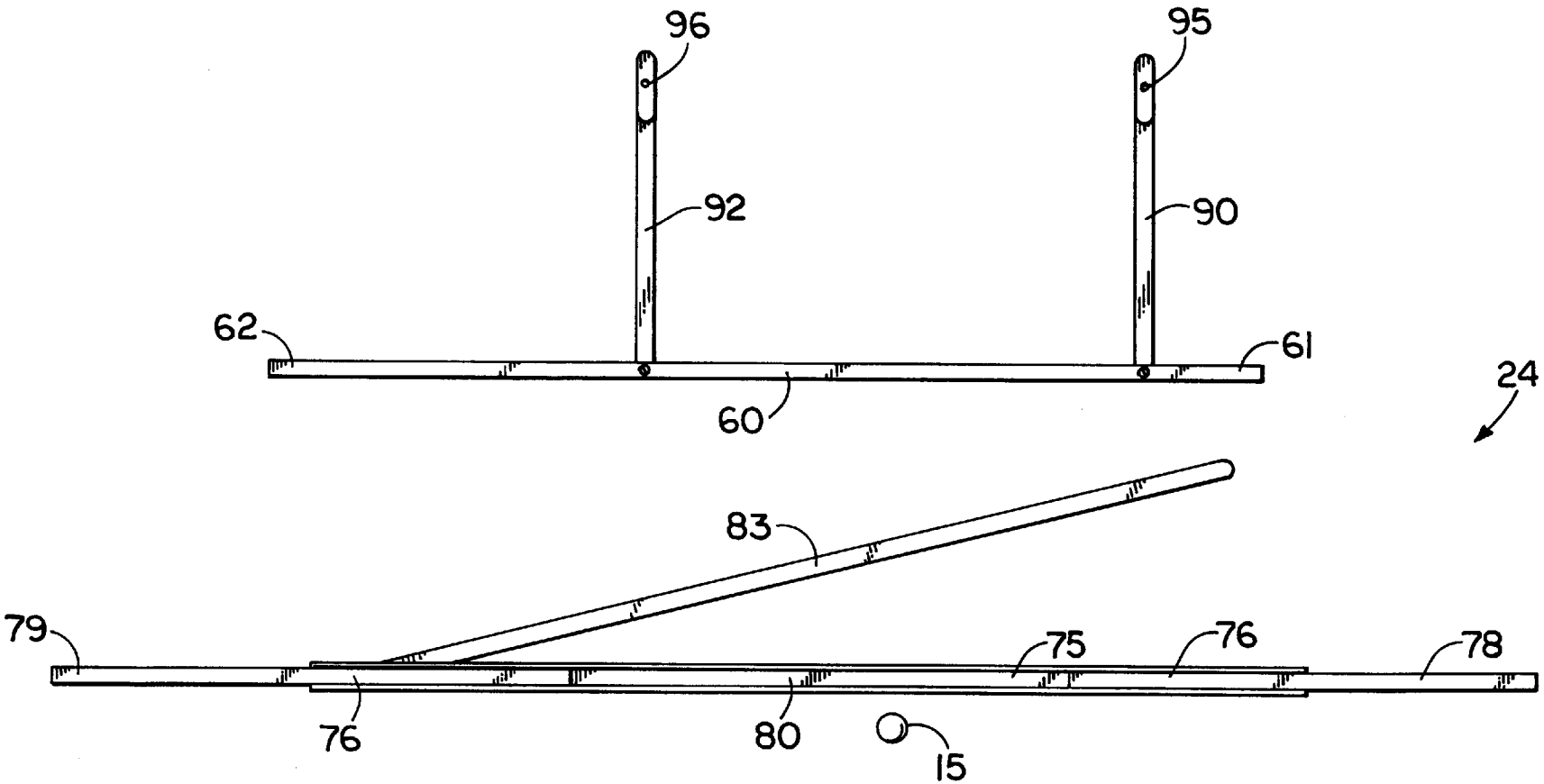
FIG. 18 is a partial top view of a golf swing plane training device, according to an embodiment of this invention.
Figure 19:
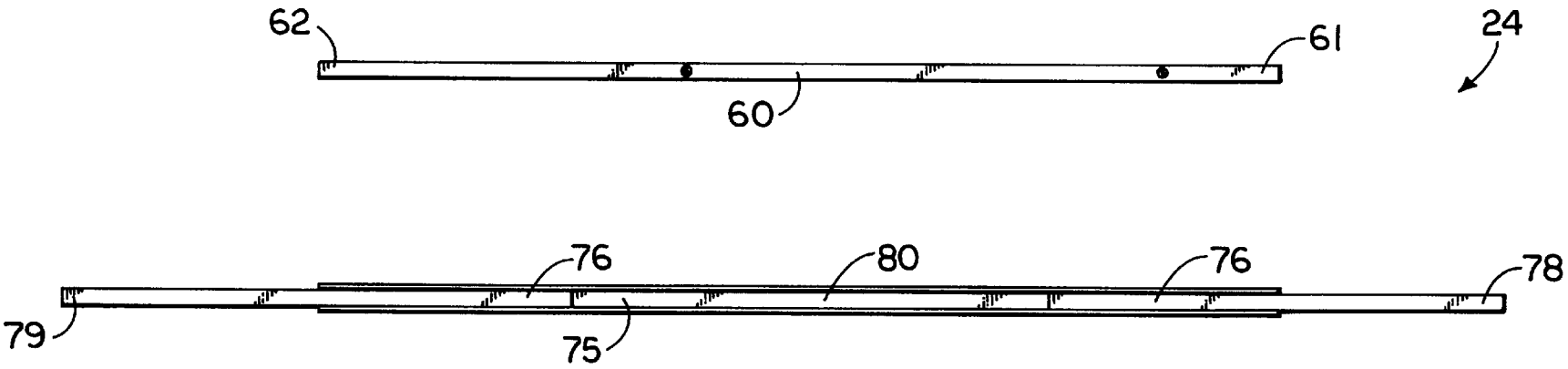
FIG. 19 is a partial top view of a golf swing plane training device, according to an embodiment of this invention.
Figure 20:
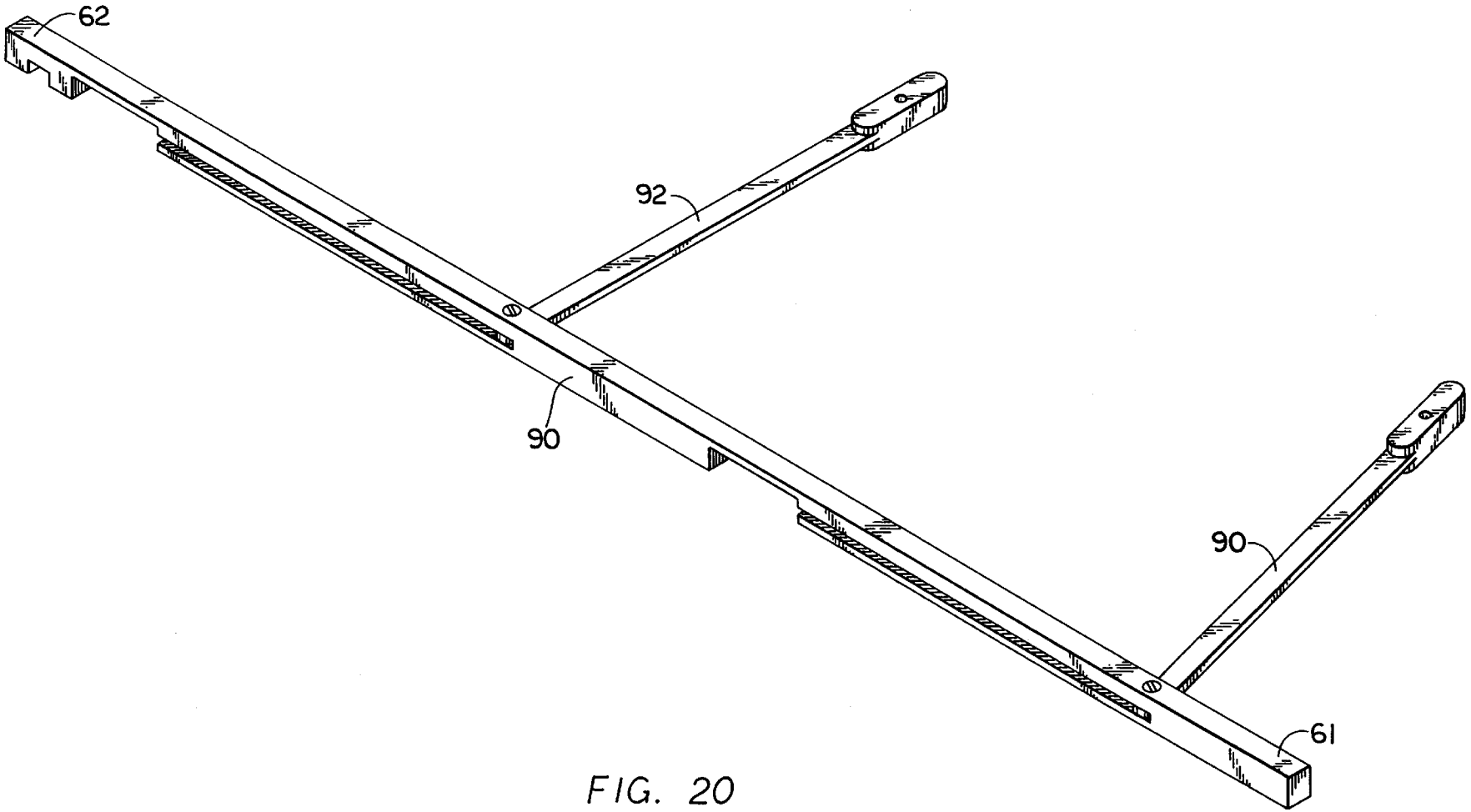
FIG. 20 is a partial perspective view of a golf swing plane training device, according to an embodiment of this invention.
Figure 21:
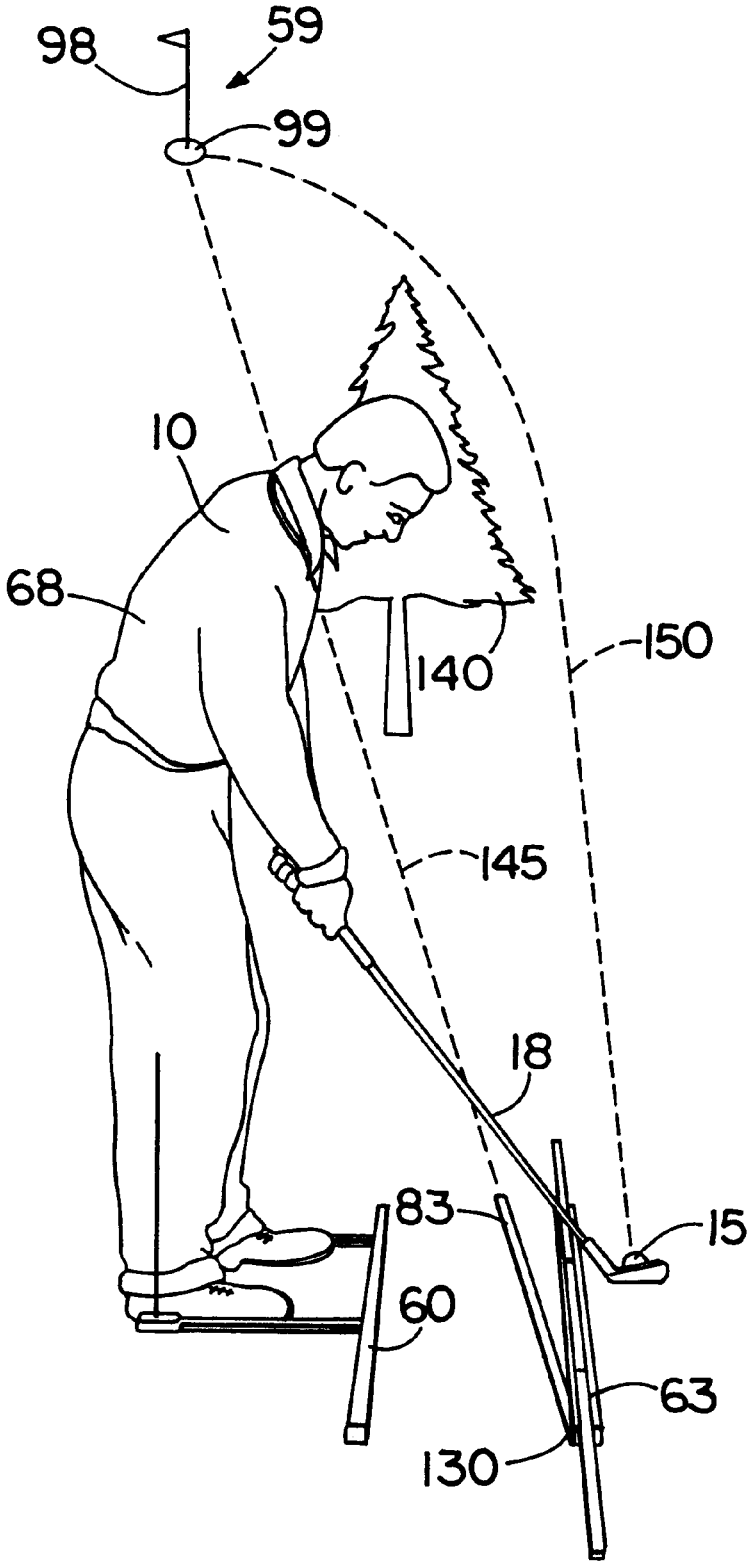

As detailed in FIGS. 12, 18 and 21, an alternative configuration of the swing training device 20 of the present invention can be utilized to practice and perfect the draw shot. First, the stance track 60 of the swing platform 24 is preferably oriented to a forward edge of an obstacle, such as a tree 140, as shown in FIG. 21, that the golfer desires to avoid. The golfer 10 then disengages the connector bar 83 from the stance track and pivots the connector bar about the connector bar pivot 130 as detailed in FIG. 31, to the draw line position, as shown in FIG. 18. The connector bar easily rotates about the connector bar pivot on the swing track 63. In the draw line position, the connector bar is positioned to point toward the desired target 59, to establish a draw line 145, as shown in FIG. 21. For the draw training position, as shown in FIG. 18, the swing track is in substantially the same position relative to the stance track 60 as in the drive swing training configuration, as described herein above. However, in the draw training position the swing track is positioned closer to the stance track to allow the ball 15 to be placed outside the swing track, to the forward direction from the golfer, as shown in FIGS. 12 and 21.

In the method of utilizing the present device in the draw swing training configuration as shown in FIG. 12, the golfer 10 positions his feet 47 along the stance track 60 as with the drive swing training configuration, as described herein above. The head 21 of the golf club 18 includes a face 125. The face is the surface of the head that impacts the golf ball 15. In the drive swing, the face of the golf club 18 is preferably square to the ball and the target 59, with the toe 17 of the golf club pointed perpendicular to the stance track at impact with the golf ball. In the draw swing, the golf club must impact the ball with a closed face. The closed face is achieved by rotating the toe of the club slightly toward the target, so that the face of the golf club is again square to the target and perpendicular to the draw line 145. In the draw swing training configuration the connector bar 83 is utilized to calculate the required amount closure, or how far to point the toe of the club toward the target, for achieving the correct trajectory for the draw shot.

FIG. 12 shows the golfer 10 calculating the correct closure of the face 125 of the golf club 18 for the draw shot. To calculate the correct closure of the face, the golfer places the head 21 of the golf club on the connector bar 83, that points to the target 59 along the draw line 145, and rotates the head of the golf club so the face of the golf club is perpendicular to the draw line. The golfer then assumes the address position, while maintaining the calculated face angle in the head of the golf club. With a proper swing, executed in the drive swing method as detailed herein above, the golf ball 15 will approximately follow a draw trajectory 150 as shown in FIG. 21.

Opposite to the draw, a fade is a also a finesse golf shot also utilized to curve the trajectory of the golf ball 15 around an obstacle blocking the desired target 59. The "fade" shot is described as a controlled or intentional slice. The slice can be defined as an unintentional trajectory of the golf ball toward the front 65 of the golfer 10. The golfer may, in certain instances, desire some of this "frontward" arc in the trajectory of the golf ball. This is typically the case when the obstacle is blocking the direct trajectory path between the golfer and the target. Like the draw shot, most golfers have great difficulty in perfecting an accurate and controlled fade shot.

Figure 13:
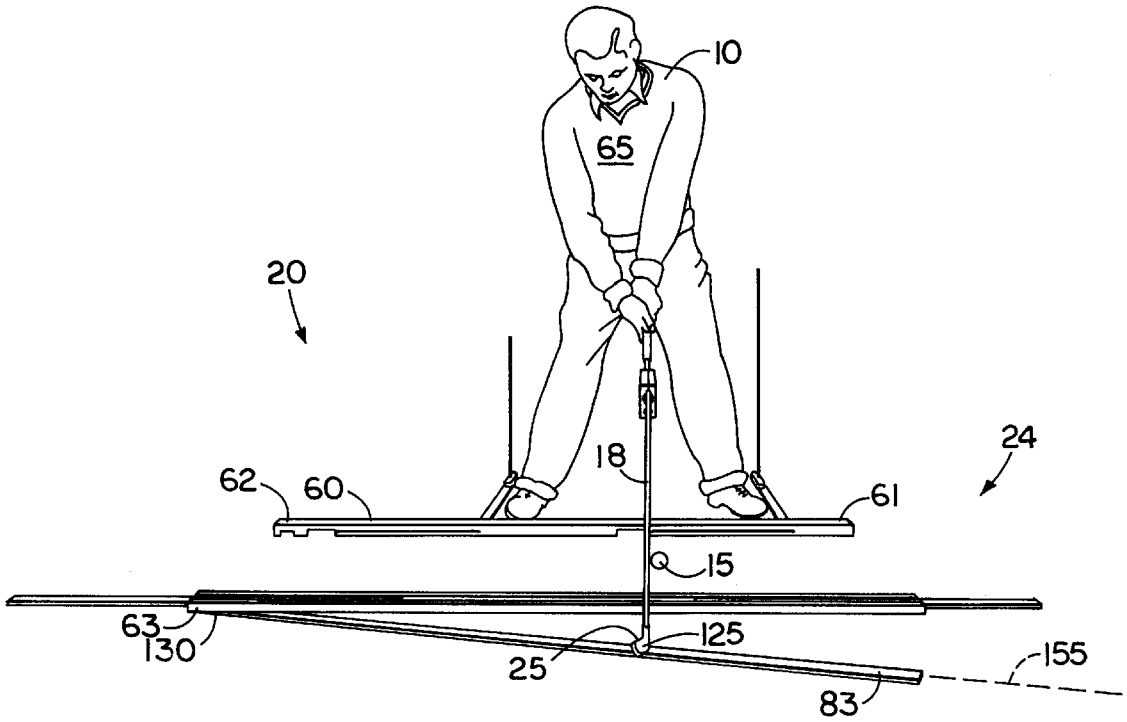
FIG. 13 is a frontal perspective view of a golf swing plane training device, according to an embodiment of this invention.
Figure 14:
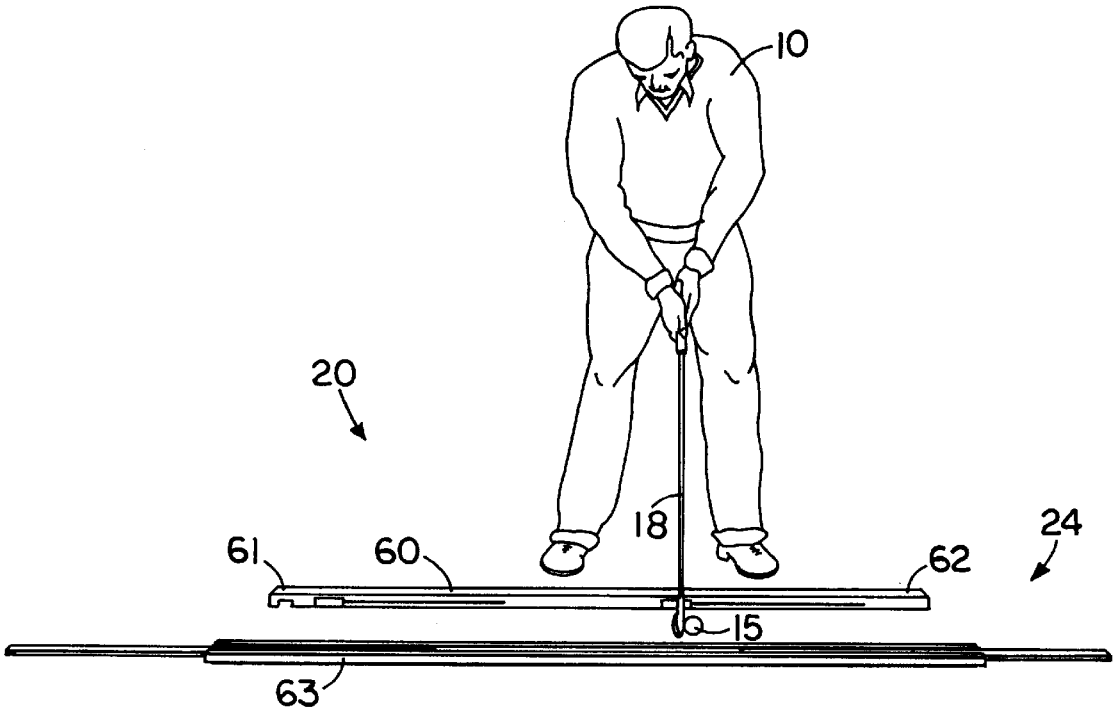
FIG. 14 is a frontal perspective view of a golf swing plane training device, according to an embodiment of this invention.
Figure 17:
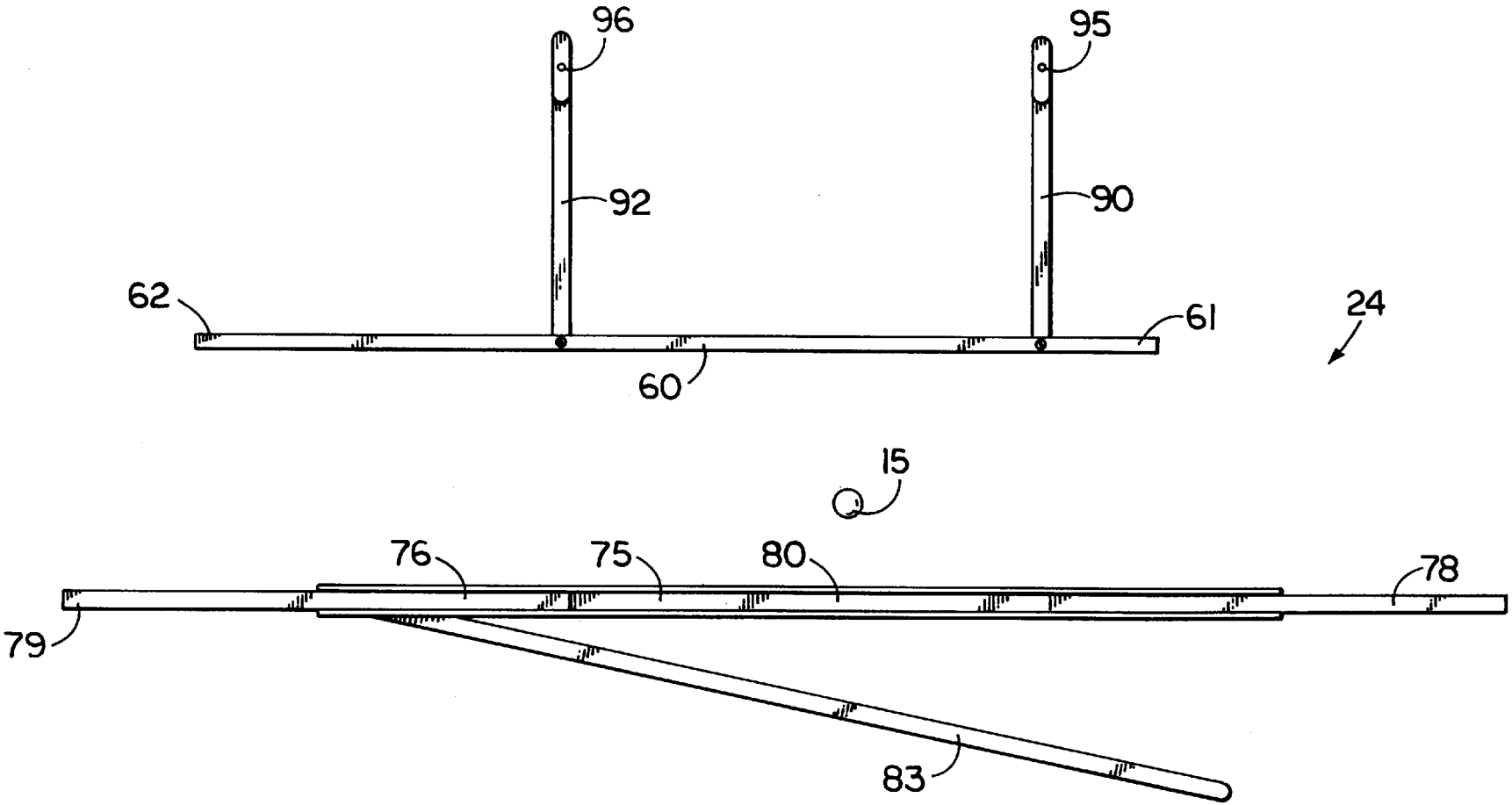
FIG. 17 is a partial top view of a golf swing plane training device, according to an embodiment of this invention.
Figure 22:
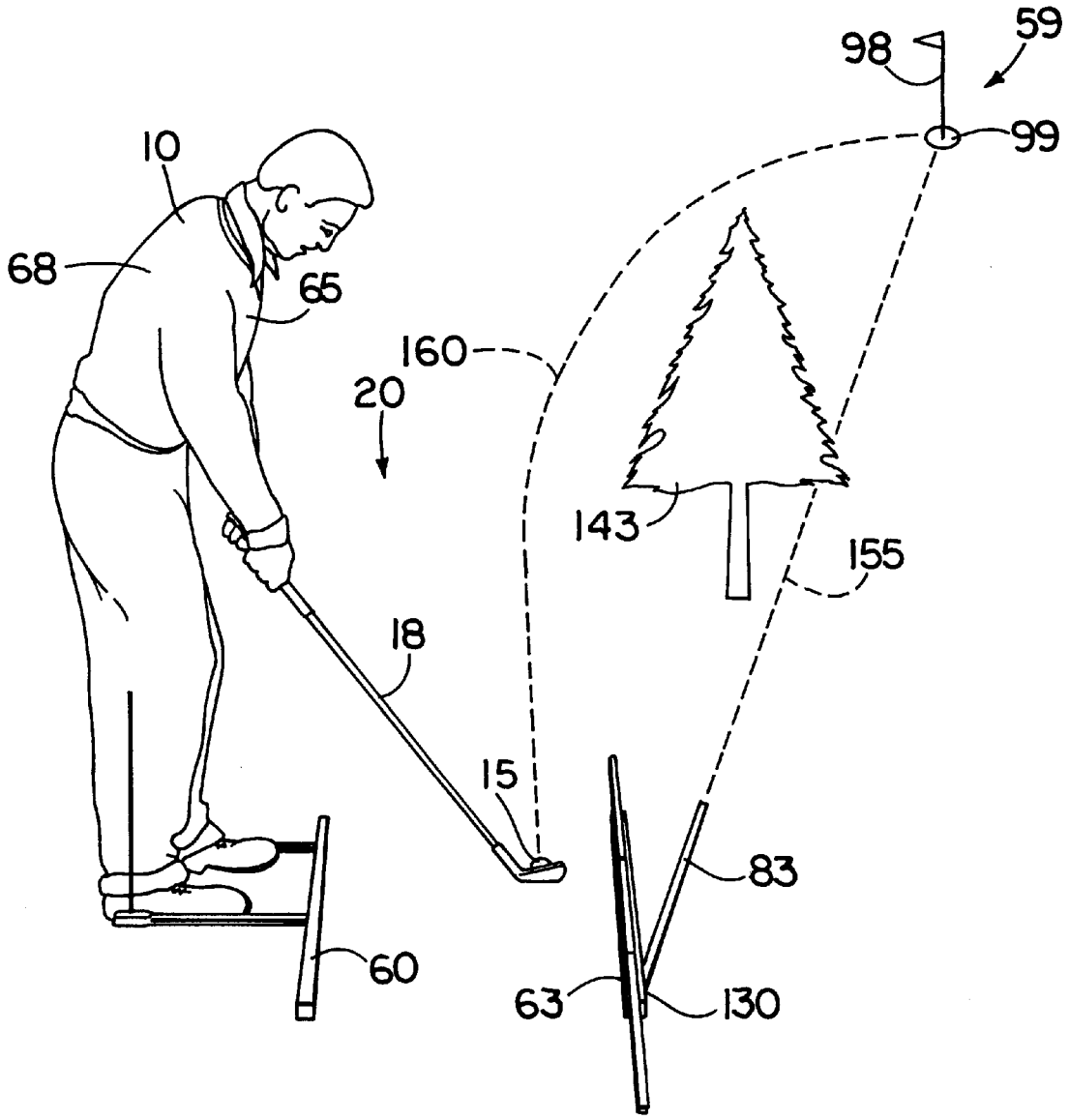
FIG. 22 is a rearward side perspective view of a golf swing plane training device, according to an embodiment of this invention.
Figures 23, 24, 25, 26, 27, 28:
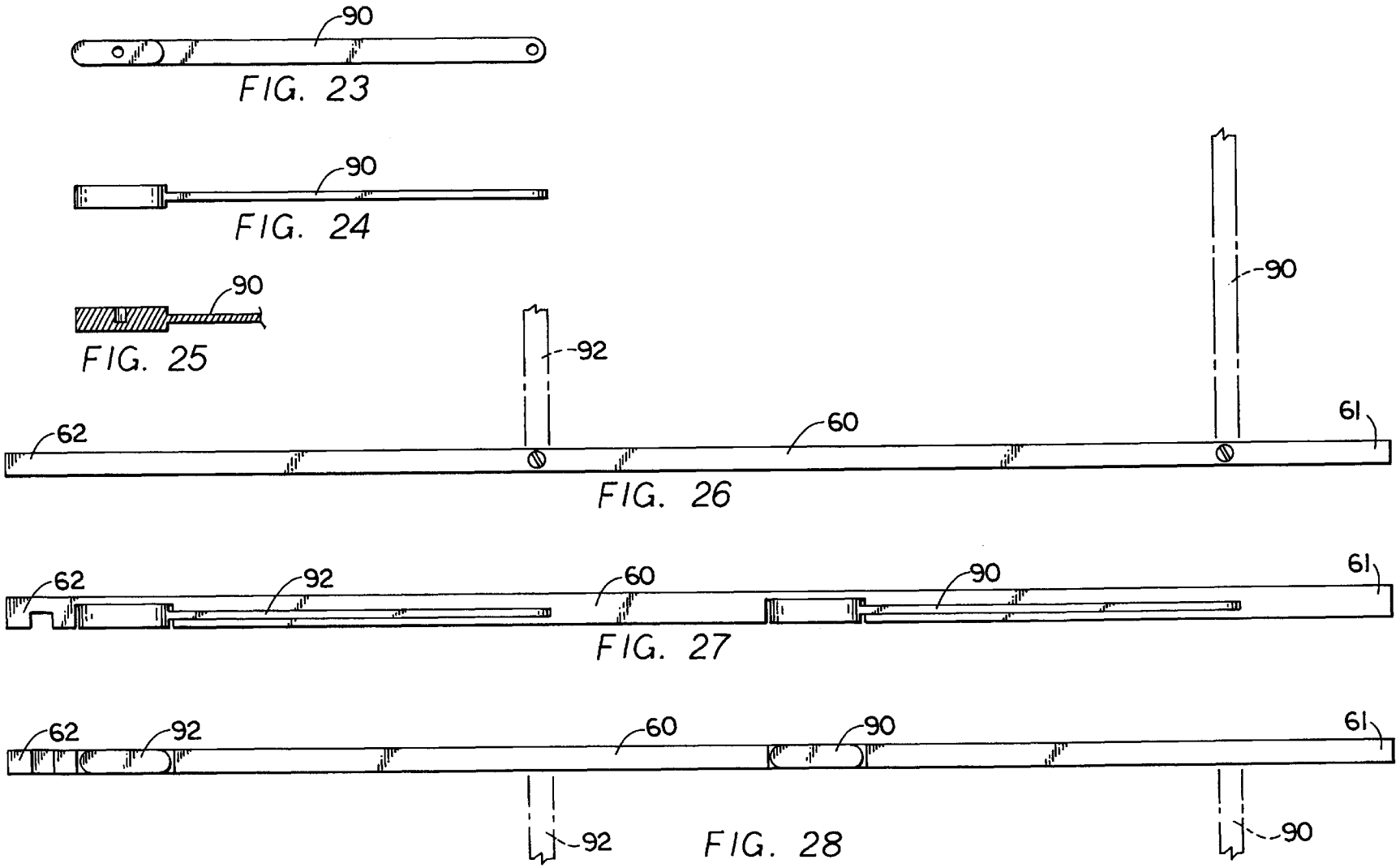
FIG. 23 is a rearward side perspective view of a golf swing plane training device, according to an embodiment of this invention.
FIG. 24 is a partial side view of a golf swing plane training device, according to an embodiment of this invention.
FIG. 25 is a sectioned side view of a portion of a golf swing plane training device, according to an embodiment of this invention.
FIG. 26 is a partial top view of a golf swing plane training device, according to an embodiment of this invention.
FIG. 27 is a partial side view of a golf swing plane training device, according to an embodiment of this invention.
FIG. 28 is a partial top view of a golf swing plane training device, according to an embodiment of this invention.

As detailed in FIGS. 13, 17 and 22, an alternative configuration of the swing training device 20 of the present invention can be utilized to practice and perfect the fade shot. First, the stance track 60 of the swing plane platform 24 is oriented to the rearward edge of the obstacle, such as a tree 143 that the golfer 10 desires to avoid. The golfer then disengages the connector bar 83 from the stance track and pivots the connector bar to the fade line position, as shown in FIG. 17. The connector bar 83 easily pivots upon the connector bar attachment 130 to the swing track 63. In the fade swing training position, as shown in FIG. 13, the swing track is in substantially the same position relative to the stance track as in the drive swing training configuration, as described herein above. However, in the fade swing training position, the connector bar rotates about the connector bar pivot 130 to point toward the desired target 59 to establish a fade line 155, as shown in FIG. 22.

In the method of utilizing the fade swing training configuration, the golfer 10 positions his feet 47 along the stance track, as in the drive swing training configuration. In the fade swing the golf club 18 must impact the ball 15 with an opened face 125, as shown in FIG. 13. The open face is achieved by pointing the toe of the club slightly toward the target 59, so that the face of the golf club is square to the target and perpendicular to the fade line 155. In the fade swing training configuration, the connector bar 83 is utilized to calculate the required amount of opening of the face, or how far to rotate the toe 17 of the club toward the target, for achieving the correct trajectory for the fade shot.

FIG. 13 shows the golfer calculating the correct amount of opening of the face 125 for the fade shot. To calculate the correct opening of the face, the golfer places the head 21 of the golf club on the swing track 63, and rotates the head of the golf club so the face is perpendicular with the fade line 155. Once the correct opening of the face is calculated, the golfer 10 assumes the address position and swings the golf club 18 employing the same method as described herein above for the drive swing configuration. With a proper swing, executed in the drive swing method, the golf ball 15 will approximately follow a draw trajectory 160 as shown in FIG. 22.

The putt swing training configuration is another alternative configuration of the swing training device 20 of the present invention. The putt swing training configuration allows the golfer 10 to practice putting to achieve kinesthetic benefits similar to those of to the drive swing training method. To set up the putt training configuration, the golfer positions the pair of parallel tracks 24 on the ground 19, similar to the drive swing configuration, with the swing track 63 parallel to the stance track 60. However, in the putt training position, the golfer only narrowly separates the swing track from the stance track and employs them to precisely align the putt with the target 59.

Preferably, another feature of the swing training device 20 is that it can collapse for easy storage. FIG. 32 shows the swing track in the collapsed position. Preferably, the forward element 78 and the rear element 79 of the swing track 63 retract into the swing track. Once collapsed, the golf swing training device fits into a standard golf bag for transport. Preferably the golf swing training device is also light in weight. A conventional, fracture resistant plastic or a water sealed hard wood are preferred materials preferably utilized to manufacture the swing training device. Metal is also considered as an alternative material of manufacture for the swing training device, however the expense of the material along with the increase in fabrication costs, currently make plastic and wood the best choices.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims that follow.

What is claimed is:

1. A method for golf swing training that includes the steps of:

a) attaching a training light to a shaft of a golf club;

b) projecting a head beam of light from the training light;

c) directing the head beam of light parallel to the shaft of the golf club, toward the head of the golf club;

d) projecting a grip beam of light from the training light e) directing the grip beam of light parallel to the golf club shaft, toward the grip of the golf club;

f) positioning a pair of parallel tracks on the ground, in front of a user, the parallel tracks including a stance track and a swing track;

g) attaching an optically reflective means to the top surface of the swing track, h) swinging the golf club to reflect the head beam off of the optically reflective means; and i) swinging the golf club to reflect the grip beam of light off of the optically reflective means.

2. The method of claim 1, additionally including the step of:

j) adjusting the pair of parallel tracks to suit various club lengths and club types.

3. The method of claim 1, additionally including the step of:

j) observing the light projections from the training light.

4. The method of claim 1, additionally including the step of:

j) observing the light projections from the training light as reflected from the optically reflective means.

5. The method of claim 1, additionally including the step of:

j) attaching at least one vertical swing guide wand to the stance track.

* * * * *